US005547294A

United States Patent [19]

Nakayama et al.

[11] Patent Number: 5,547,294

[45] Date of Patent: Aug. 20, 1996

[54] METHOD AND APPARATUS FOR CONTROLLING SERIAL PRINTER

[75] Inventors: Ichirou Nakayama; Masami Ookawa, both of Nagano, Japan

[73] Assignee: Seiko Epson Corporation, Tokyo, Japan

[21] Appl. No.: 994,305

[22] Filed: Dec. 21, 1992

[30] Foreign Application Priority Data

| | | | |
|---|---|---|---|
| Dec. 19, 1991 | [JP] | Japan | 3-337249 |
| Apr. 1, 1992 | [JP] | Japan | 4-079940 |
| Jun. 2, 1992 | [JP] | Japan | 4-141444 |
| Nov. 20, 1992 | [JP] | Japan | 4-312211 |

[51] Int. Cl.[6] ..... B41J 1/22

[52] U.S. Cl. ..... 400/145; 400/146

[58] Field of Search ..... 400/145, 145.1, 400/145.2, 146; 101/93.13, 93.15–93.18, 93.21

[56] References Cited

U.S. PATENT DOCUMENTS

| | | | |
|---|---|---|---|
| 4,469,460 | 9/1984 | Hughes | 101/93.16 |
| 4,527,920 | 7/1985 | Mako | 400/146 |
| 4,653,946 | 3/1987 | Thanos | 400/144.2 |
| 4,806,029 | 2/1989 | Takahashi | 400/144.2 |
| 4,821,639 | 4/1989 | Carrington | 400/146 |

FOREIGN PATENT DOCUMENTS

| | | | |
|---|---|---|---|
| 1-54775 | 6/1989 | Japan | 400/120 |

*Primary Examiner*—David A. Wiecking
*Assistant Examiner*—Steven S. Kelley
*Attorney, Agent, or Firm*—Sughrue, Mion, Zinn, Macpeak & Seas

[57] ABSTRACT

A method and apparatus for controlling a serial printer of the invention selects a first digit character by counting a predetermined number of timing pulses that starts to be generated during carriage return and sets the predetermined number so as to correspond to the character to be printed and the number of digits printed in a last line. The apparatus may include a time measuring device, and selects a first digit character to be printed in succession to a last line by measuring a predetermined carriage return time and sets the predetermined carriage return time so as to correspond to the character to be printed and the number of digits printed in the last line. The apparatus also may include a timing pulse interval detector, and a first digit character is selected after the selection of a character group by counting a predetermined number of timing pulses and the predetermined number is set so as to correspond to the character to be printed and the number of digits printed in the last line. The apparatus may also include a temperature measuring device, and a first digit character to be printed in succession is selected by counting a predetermined number of timing pulses that start to be generated during the carriage return and sets the predetermined number so as to correspond to the temperature measured by the temperature measuring device.

22 Claims, 18 Drawing Sheets

| CONTROL / NUMBER OF PRINT DIGITS | PRIOR ART (LINE/SEC) | PRESENT INVENTION (LINE/SEC) | RATIO |
|---|---|---|---|
| 2 DIGITS | 5.6 | 7.0 | 1.3 |
| 7 DIGITS | 1.9 | 2.1 | 1.1 |
| 19 DIGITS | 0.9 | 0.9 | 1.0 |

METHOD AND APPARATUS FOR CONTROLLING SERIAL PRINTER

BACKGROUND OF THE INVENTION

The present invention relates to controllers for serial printers, for use with electronic calculators and the like, using a DC motor as a drive source and printing information by moving a print head in a digit direction.

As disclosed in Japanese Patent Unexamined Publications Nos. 57-182472/(1982) and 58-112781/(1983), controllers of this type are widely used in serial printers which print information by causing a carriage to select a character pattern to be printed from the inner side of a plurality of character wheels, each having a plurality of characters. The carriage moves in a digit direction. An example of such serial printer 100 is shown in FIG. 8.

The conventional systems will be described with reference to FIGS. 9–16. FIG. 9 is a schematic diagram of the serial printer, FIG. 10 is a perspective view of a character group switching mechanism, FIGS. 11, 13 and 15 are timing charts of the serial printer, and FIGS. 12, 14 and 16 are graphs showing behaviors of mechanical parts of the serial printer. Since the serial printer described with reference to the invention is disclosed in Japanese Patent Unexamined Publication No. 58-145472/(1983), the operation thereof be described only briefly.

Rotation in a direction A of a DC motor 1 is transmitted from a motor gear 2 to a reducing gear 3 and a planetary gear 4, and then distributed therefrom to a print switching gear 5 and a selection drive gear 16. The thus-transmitted rotational motion of the print switching gear 5 is further coupled to a print gear 6 to cause a print shaft 7 to rotate in a direction B, whereas the rotational motion of the selection drive gear 16 is further coupled to a selection gear 17 to cause a character wheel shaft 20 to rotate in a direction C. Switching between the print shaft 7 and the character wheel shaft 20 is effected by stopping the rotation while causing a selection pawl 18 to be engaged with either the print switching gear 5 or the selection gear 17. The selection pawl 18 is driven by an electromagnet 19.

A print cam 9 is mounted on the print shaft 7. The print cam 9 is axially slidable, rotates in phase with the print shaft 7, and is disposed within a carriage 8. When the print cam 9 makes a single full rotation, a hammer 11 is driven through a hammer transmission lever 10, the hammer biases a character wheel 14 inked by an ink roll 12 mounted on a character wheel body 13, whereby information is printed on a sheet 15. Upon printing, the position of the carriage is displaced to an upper digit by engagement of a carry lead 9*a* with a positioning plate 25. The character wheel body 13, a character clutch 29, an outer clutch 27, an intermediate clutch 28, and a detecting wheel 21 are arranged on the character wheel shaft 20. The character wheel body 13 and the character clutch 29 are axially slidable and rotate in phase with the character wheel shaft 20. The outer clutch 27 and the intermediate clutch 28 are rotatably supported irrespective of the rotational phase of the character wheel shaft 20. The detecting wheel 21 rotates integrally with the character wheel shaft 20. The character wheel body 13 holds character groups 14*a*, 14*b*, 14*c*. The rotational phase of the character wheel body 13 is detected by a timing pulse detected by a detecting brush 22 and a reset pulse (hereinafter referred to as "RP") detected by a detecting brush 23. The detecting brushes 22, 23 slidably contact the detecting wheel 21. Since the character wheel 14 described in this embodiment is divided into 14 segments, 14 timing pulses are generated in one full rotation of the detecting wheel 21. The carriage 8 is biased by a spring 24 in a direction D. The character wheel 14 and the character clutch 29 are biased by a character wheel spring 26 and a clutch spring 30 in the direction D and a direction E, respectively.

Upon application of a motor drive signal a, counting of the number of timing pulses b is started while being reset to zero after a reset pulse c. A character selection signal d is applied at the number of timing pulses corresponding to a desired character to print such desired character. The time interval between the rise of a first digit character selection signal d and the fall thereof is measured by a timer (not shown) that is activated at the rise of the character selection signal d. Such measurement is made to allow the carriage of the serial printer described in this embodiment to return by a carriage return start conduction that adds a multiple of the interval during which the character selection signal d is turned on to the application of the character selection signal d.

A carriage operation f is performed after the character selection signal d has been applied. A character wheel body operation g is interlocked therewith up to a character group selection digit. After the character group has been selected, the carriage 8 is displaced relative to the character wheel body 13 by the distance at which each character group is arranged. The carriage operation f is again interlocked with the character wheel body operation g.

At this point, the timing pulse to be generated in correspondence to the character wheel that starts rotating again is a timing pulse that corresponds to a character next to a character selected for printing.

Hereinbelow, the operation of selecting the character groups 14*a*, 14*b*, 14*c* will be described with reference to FIGS. 9 and 10. Since the pawl 8*a* of the carriage 8 and a notch 27*a* of the outer clutch 27 are engaged with each other up to a predetermined digit, the hammer 11 mounted on the carriage 8 is positioned relative to the character group 14*a* (see FIG. 10). In the meantime, the intermediate clutch 28 is rotated by the character clutch 29 in phase with each other. At the character group selection digit, a character is selected at a position at which either a projected portion 28*a* or a recessed portion 28*b* of the intermediate clutch 28 confronts the pawl 8*a* of the carriage 8, and rotation of the character wheel shaft 20 is stopped. When the carriage is displaced to an upper digit, the outer clutch 27 is rotated by a cam (not shown) in a direction F. Accordingly, the pawl 8*a* is disengaged from the notch portion 27*a*, moving the character wheel body 13, the outer clutch 27, and the intermediate clutch 28 in the direction D by the force of the character wheel spring 26. When the pawl 8*a* is engaged with the recessed portion 27*a* of the outer clutch 27, the hammer 11 confronts the character wheel 14*c*, whereas when the pawl 8*a* is engaged with the projected portion 28*a* of the intermediate clutch 28, the hammer 11 confronts the character wheel 14*b*.

Generation of timing pulses is started again as the character wheel, which has been stopped during printing before completing the engagement of the pawl 8*a* with the recessed portion 27*a* of the outer clutch 27 or with the projected portion 28*a* of the intermediate clutch 28 after the character group has moved, starts rotating.

It is apparent, even without reference to FIG. 12 (described below), that the time required for displacement is longer when the character wheel 14*c*, whose displacement is larger, is selected than when the character wheel 14*b*, whose displacement is smaller, is selected.

Further, the character wheel body 13, the outer clutch 27, and the intermediate clutch 28 slide over the character wheel shaft 20. Since the lateral pressure applied from the character wheel shaft 20 increases in proportion to the rotational speed of the character wheel shaft and the sliding resistance due to friction increases with increasing rotational speed of the character wheel shaft, the time required for displacing the character groups is increased.

Further, at low temperatures, the viscosity of a lubricant applied to the sliding portion of the character wheel body 13 and the character wheel shaft 20 increases, which in turn increases the sliding resistance. As a result, the time required for displacing the character groups is increased.

Similarly, as the printer is used more frequently, the sliding portion between the character wheel body 13 and the character wheel shaft 20 not only becomes contaminated by ink, sheet powder, or the like, but the lubricant also becomes deteriorated, thus increasing the sliding resistance and increasing the time required for displacing the character groups.

A character selection signal d for the next digit after the desired character group has been selected is applied after counting a predetermined number of timing pulses N1 preset as a single number of timing pulses allowing both the hammer 11 and a desired character group to be displaced to a position at which they confront each other correctly (hereinafter referred to as "the number of character group slide timing pulses").

In the character wheel body operation g in FIG. 11, the operation of selecting the character group 14*c* when the interval between timing pulses is short (at a high motor speed) is designated by n, the operation of selecting the character group 14*b* when the interval between timing pulses is short is designated by q, and the operation of selecting the character group 14*c* when the interval between timing pulses is long is designated by m.

FIG. 12 is a graph showing the number of character group slide timing pulses in relation to the timing pulse interval. The "+" mark designates the worst value out of data obtained in each timing pulse interval required for moving the character wheel body 13 from the character group 14*a* to the character group 14*c*, whereas mark "o" designates the value required for moving the character wheel body 13 from the character group 14*a* to the character group 14*b*.

From this data, a value N2 has been set as the number of wait timing pulses. The number of wait timing pulses is a time between a character group slide completion after a character group selection conduction and a next digit selection is ready. The number of wait timing pulses, i.e., N2, has been selected by considering variations based when the number of character group slide timing pulses is maximized, i.e., when the character wheel 14*c* is selected and when conditions such as ambient temperature, power supply voltage affecting the rotational speed of the character wheel shaft, or the rotational speed of a DC motor, and frequency of use, are the worst.

When the character selection has been ended at the most significant digit, a carriage return conduction j shown in the character selection signal d in FIG. 13 is effected. As a result, the carry lead 9*a* of the print cam 9 is disengaged from a projection 25*a* of the positioning plate 25, the carriage 8 and the character wheel body 13 are displaced in the direction D to return to the home position by the force stored in the character wheel spring 26 and the carriage spring 24. Unless the number of print digits is so small as 2 or 3, the character wheels that have been stationary during printing begin rotating before the carriage completely returns to the home position. As a result, generation of timing pulses is started again.

While the character wheel body 13 supporting the character wheels slides over the character wheel shaft 20, the lateral pressure applied by the character wheel shaft 20 increases in proportion to the rotational speed of the character wheel shaft 20. Thus, the larger the rotational speed of the character wheel shaft, the larger the sliding resistance due to friction. As a result, the time required for the carriage to return increases as well. At low temperatures, the viscosity of the lubricant applied to the sliding part of the character wheel body 13 and the character wheel shaft 20 increases, which in turn increases the sliding resistance. As a result, the time required for the carriage to return to the home position increases as well.

Similarly, as the printer is used more often, the sliding part between the character wheel body 13 and the character wheel shaft 20 not only is contaminated by ink, sheet powder, or the like, but the lubricant also deteriorates, thus increasing the sliding resistance as well as the time required for the carriage to return.

When printing subsequent lines continuously, the character selection signal d is applied after the preset number of timing pulses in which the carriage can make a complete return to the home position has been counted.

As described above, the time required for the carriage to return to the home position differs depending on the number of printed digits (the distance to be returned), the ambient temperature, the power supply voltage determining the rotational speed of the character wheel, i.e., the rotational speed of the DC motor, and the frequency of use. Therefore, the value that permits printing of the most significant digit and printing under the worst conditions in terms of temperature, power supply voltage, and frequency of use, has been selected as the time required for the carriage to return.

FIG. 14 is a graph showing the number of carriage return timing pulses as a function of the timing pulse interval. Mark "+" designates the worst data obtained from each timing pulse interval.

From this data, a value N3 has been set as the number of wait timing pulses. The number of wait timing pulses is a time between a carriage return completion after a carriage return conduction j and a next line character selection is ready. The number of wait timing pulses, i.e., N3, has been selected by considering variations based on the maximum number of timing pulses generated before the carriage returns to the home position (hereinafter referred to as "the number of carriage return timing pulses"), as shown in FIG. 13.

FIG. 16 is a graph showing the number of carriage return timing pulses as a function of temperature. Mark "+" designates the worst data obtained from each temperature. From this data, the value N2 has been used as the number of wait timing pulses, which is a time between a carriage return completion after a carriage return conduction j and a next line character selection is ready, by considering variations based on the maximum number of timing pulses generated before the carriage returns to the home position, as shown in FIG. 15.

However, in the conventional systems, the number of wait timing pulses, or wait time, between a carriage return completion in which the carriage returns in the digit direction and a next line character selection ready has been set to a constant value, which does not depend on the number of printed digits. For this reason, (1) even if the carriage could return to the home position within a shorter time because the number of printed digits is small and thus the return distance is short, the carriage must wait for a time longer than required, thus increasing the time required for printing a single line of characters, i.e., slowing the print speed.

FIG. 3 is a part of a flowchart showing the operation of an exemplary controller of a conventional printer. The controller is designed to count in Step P3*a* a constant time required for printing the largest number of digits, not depending on the number of digits actually printed, as the number of timing pulses to be generated by the printer for control upon completion of printing a single line of characters. FIG. 4 is a portion of a flowchart showing the operation of another conventional controller in which a timer provided in a control circuit (including a program) is used to measure a constant return wait time in Step P4*a*. Again, it is a constant time required for printing the largest number of digits, not depending on the number of digits actually printed, that is counted as a wait time to a next line character selection ready timing.

FIG. 5 shows the breakdown of print times by a conventional controller. Carriage return wait times (e.g., the same as the number of wait timing pulses) P5*a*, P5*b*, P5*c* among print times for a single line are constant time periods required for printing the largest number of digits, and thus do not depend on the number of digits actually printed. Thus, the smaller the number of digits printed, the larger the percentage of the carriage return wait time. Additionally, the smaller the number of digits printed, the longer the carriage return wait time becomes than is required, as described before.

Further, according to the conventional systems, the number of next digit selection wait timing pulses between character group selection and selection completion is selected not only on based on the maximum number of character group slide timing pulses at the maximum rotational speed of the motor at the highest voltage (e.g., the minimum timing pulse interval), but also in consideration of conditions at low temperatures at which the character group slide time increases. The durability of the motor is taken into account in the maximum rotational speed of the motor. For this reason, (2) the number of wait timing pulses is set to a value far larger than is required under the normal conditions, thus preventing the print speed from being improved.

To overcome this problem, the character group slide time must be curtailed. If the load of the character wheel spring is set to a large value, the printer load is increased, thereby increasing costs due to high power consumption and expensive heavy-duty parts. Further, the printer is noisier during carriage return.

Further, the controller for a conventional serial printer has regularly set the next digit selection wait time to character group slide completion irrespective of the character group slide time that differs from one character group to another. For this reason, (3) a character group that is used most frequently is located at a position for which a small number of character group slide timing pulses is set. Therefore, even if the character group is selected and printed, the print speed is not improved.

Further, when the serial printer is employed in an electronic calculator, or the like, an alkali battery or an inexpensive low-capacity ac adaptor is used as a power source thereof. The battery is seldom used at the maximum voltage, but instead is usually used at a voltage lower than the center (i.e., intermediate) voltage. The ac adaptor is usually used at a voltage lower than the center voltage during printer driving to balance low power consumption for calculation (e.g., high output voltage) with high power consumption for the printer driving (e.g., low output voltage).

Hence, the number of next line character selection wait timing pulses before return completion in the conventional systems is selected in consideration of variations based on the maximum number of carriage return timing pulses at the maximum rotational speed of the motor at the highest voltage (e.g., the minimum timing pulse interval). The durability of the motor is taken into account in the maximum rotational speed of the motor. For this reason, (4) the number of wait timing pulses is set to a value far larger than required under the normal conditions, thus preventing the print speed from being improved.

Since the electronic calculator including the serial printer is used over a wide temperature range, the number of next digit character selection wait timing pulses to carriage return completion is set based on the worst conditions at low temperatures in the above-mentioned conventional systems. For this reason, (5) the number of wait timing pulses is set to a value far larger than required under the normal conditions, thus preventing the print speed from being increased.

To overcome this problem, the character group slide time must be curtailed. As mentioned above, if the load of the character wheel spring is set to a large value, the printer load is increased, thereby increasing the printer costs due to high power consumption and expensive heavy-duty parts. Further, it is noisier than before during carriage return.

To overcome the above problem by increasing the operation speed of the printer, a motor with a larger torque is necessary. This increases the shape, weight, and price of the motor, thereby increasing the shape, weight, and price of the serial printer.

The invention has been made to overcome the above problems. Accordingly, an object of the invention is to provide a controller for a serial printer whose speed is high under often used characters, temperatures, and power supply voltages, without increasing the shape, weight, power consumption, price, or noise of the printer, and without using heavy duty (e.g., highly durable) parts.

SUMMARY OF THE INVENTION

To overcome the above problems, a method and apparatus for controlling a serial printer of the invention is characterized as follows. A first digit character to be printed in succession to a last line after a carriage moving in a digit direction has completed a printing of a single line and has returned to a print start digit, is selected by counting a predetermined number of timing pulses to be generated during the carriage return. The predetermined number is set so as to correspond to the character to be printed and the number of digits printed in the last line.

Further, a completion of the carriage return to a home position is estimated by counting a predetermined number of timing pulses to be generated in association with a rotation of a character after a predetermined character group rotation stop time, the predetermined number of timing pulses corresponding to the number of digits printed.

Still further, the invention includes a time measuring device for estimating a completion of the carriage return to the home position, the completion differing depending on the number of printed digits, and a first digit character to be printed in succession to a last line is selected by measuring a predetermined carriage return time. The predetermined carriage return time is set so as to correspond to the character to be printed and the number of digits printed in the last line.

Still further, the invention includes a device for detecting a timing pulse interval, and a first digit character after a selection of a character group is selected by counting a predetermined number of timing pulses to be generated during the character group selection. The predetermined number of timing pulses is set so as to correspond to the value detected by the timing pulse interval detecting device.

Still further, a first digit character after a selection of a character group is selected by a number of timing pulses to be generated during the selection of the character group, and the predetermined number is set so as to correspond to the selected character group.

Still further, the invention includes a device for measuring the ambient temperature of a serial printer, and a first digit character after a selection of a character group is selected by counting a predetermined number of timing pulses to be generated during the selection of the character group. The number of timing pulses is set so as to correspond to the temperature measured by the temperature measuring device.

Still further, the invention includes a device for detecting a timing pulse interval, and a first digit character to be printed in succession to a last line is selected by counting a predetermined number of timing pulses to be generated during the carriage return. The number of timing pulses is set so as to correspond to the value detected by the timing pulse interval detecting device.

Still further, the invention includes a device for detecting the ambient temperature of a serial printer, and a first digit character to be printed in succession to a last line is selected by counting a predetermined number of timing pulses to be generated during the carriage return. The number of timing pulses is set so as to correspond to the character to be printed and the temperature measured by the temperature measuring device.

According to the invention, a first digit character to be printed in succession to a last line after a carriage moving in a digit direction has completed a printing of a single line and has returned to a print start digit is selected by counting a predetermined number of timing pulses to be generated during the carriage return, and the predetermined number is set so as to correspond to the character to be printed and the number of digits printed in the last line. Therefore, since the predetermined number can be small when the number of digits to be printed is small and therefore the time required for the carriage return is short, the print speed can be improved.

Further, the invention includes a time measuring device for estimating a completion of the carriage return to the home position, the completion time differing depending on the number of printed digits, and a first digit to be printed in succession to a last line is selected by measuring a predetermined carriage return time, and the predetermined carriage return time is set so as to correspond to the character to be printed and the number of digits printed in the last line. Therefore, since the predetermined number can be small when the number of digits to be printed is small and therefore the time required for the carriage return is short, the print speed can be improved.

Still further, the invention includes a device for detecting a timing pulse interval, and a first digit character after a selection of a character group is selected by counting a predetermined number of timing pulses to be generated during the character group selection, and the predetermined number of timing pulses is set so as to correspond to the value detected by the timing pulse interval detecting device. Therefore, the selection of the character can be made to correspond to the motor speed, and the print speed of the printer can be improved since the predetermined number of timing pulses can be small when the printer is being operated under a low power supply voltage condition.

Still further, a first digit character after a selection of a character group is selected by a number of timing pulses to be generated during the selection of the character group, and the predetermined number is set so as to correspond to the selected character group. Therefore, the print speed can be improved by reducing the predetermined number in printing in which the frequently used character group is selected irrespective of the power supply voltage.

Still further, the invention includes a device for measuring the ambient temperature of the serial printer, and a first digit character after a selection of a character group is selected by counting a predetermined number of timing pulses to be generated during the selection of the character group, and the number of timing pulses is set so as to correspond to the temperature measured by the temperature measuring device. Therefore, the print speed can be improved by reducing the predetermined number of timing pulses at temperatures at which the printer is often used.

Still further, the invention includes a device for detecting a timing pulse interval, and a first digit character to be printed in succession to a last line is selected by counting a predetermined number of timing pulses to be generated during the carriage return, and the number of timing pulses is set so as to correspond to the value detected by the timing pulse interval detecting device. Therefore, the selection of the character can be made to correspond to the motor speed, and the print speed of the printer can be improved since the predetermined number of time pulses can be small for the printer being operated in a low power supply voltage region.

Still further, the invention includes a device for detecting an ambient temperature of the serial printer, and a first digit character to be printed in succession to a last line is selected by counting a predetermined number of timing pulses to be generated during the carriage return, and the number of timing pulses is set so as to correspond to the character to be printed and the temperature measured by the temperature measuring device. Therefore, the print speed can be improved by reducing the predetermined number of timing pulses at temperatures at which the printer is often used.

DESCRIPTION OF THE PREFERRED EMBODIMENTS

Preferred embodiments of the invention will be described with reference to the accompanying drawings.

First Embodiment

Figure 1:
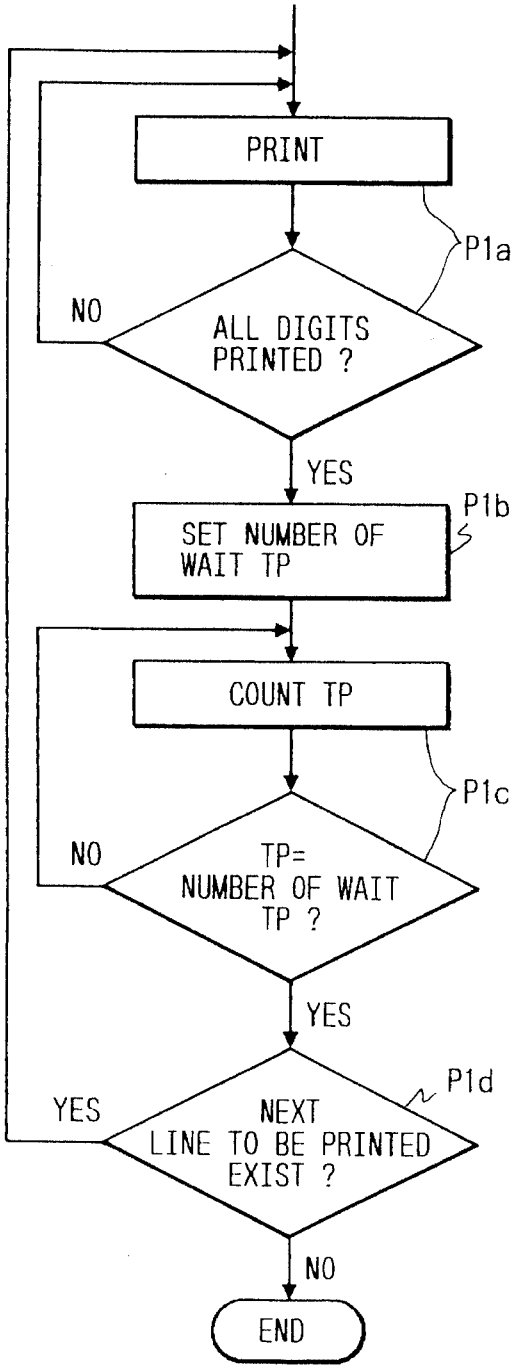
FIG. 1 is a flowchart showing a first embodiment of a printer controller according to the present invention.

FIG. 1 is a portion of a flowchart showing the operation of a controller for a printer, which is a first embodiment of the invention. The number of return wait timing pulses (e.g., the number of wait TPs) shown in Step P1*b* is set in accordance with the number of print digits. The operation will be described hereinbelow with reference to FIG. 1.

Upon completion of the printing of a first line by repeating the Step P1*a* loop, the number of return wait timing pulses is set in Step P1*b* in accordance with the digits printed. Techniques for selecting the number of return wait timing pulses based on the print digit may include selecting the number out of two wait times demarcated by a predetermined print digit, or taking a different value every time the digit is carried over. The above techniques are based on the fact that the number of wait timing pulses varies with the number of printed digits, i.e., the number of return wait timing pulses is a function of the number of printed digits. Such a concept is included in and considered by the invention. The number of return wait timing pulses is counted in the next Step P1*c* loop to wait for the number of timing pulses set in Step P1*b* to complete the printing of a single line. Then, it is determined whether there is a next line to be printed in Step P1*d*. If a next line is to be printed, the controller returns to Step P1*a* to repeat the above operation; if not, the print operation is terminated.

Second Embodiment

Figure 2:
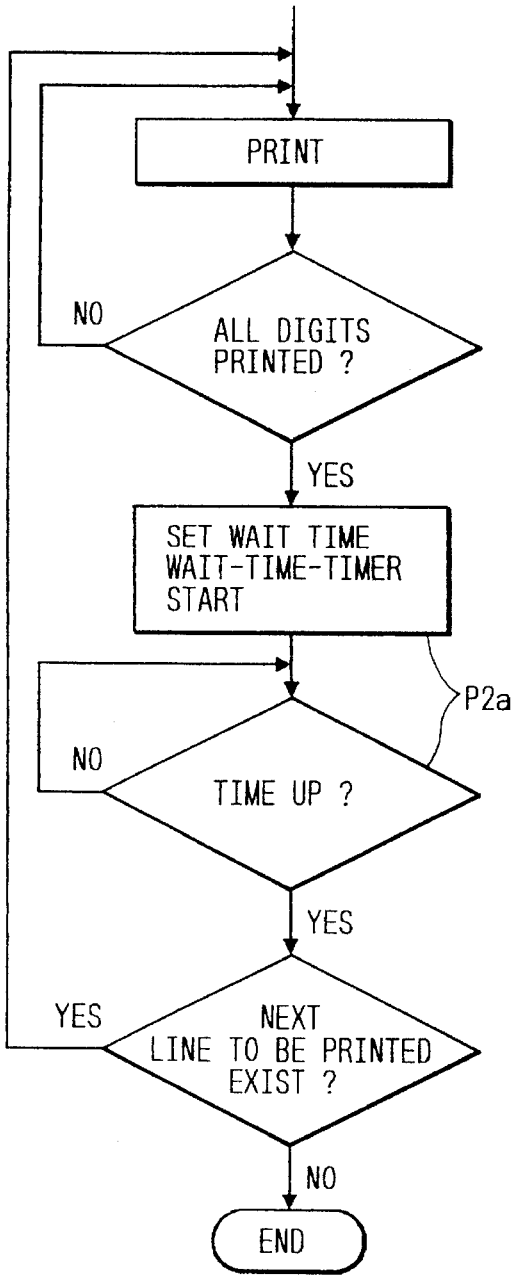
FIG. 2 is a flowchart showing a second embodiment of a printer controller according to the present invention.
Figure 3:
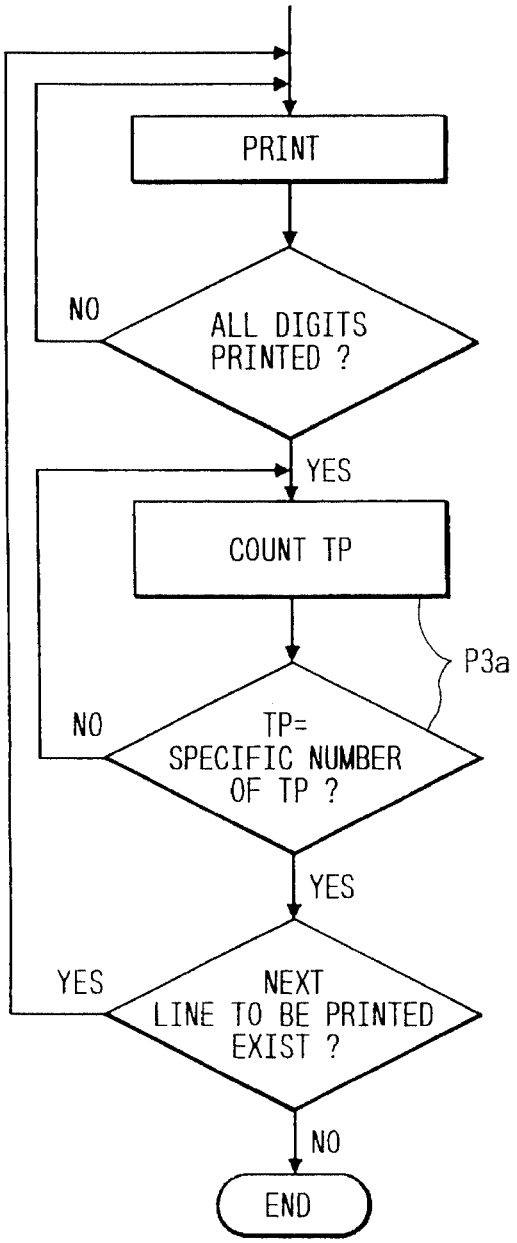
FIG. 3 is a flowchart showing an embodiment of a conventional printer controller.
Figure 4:
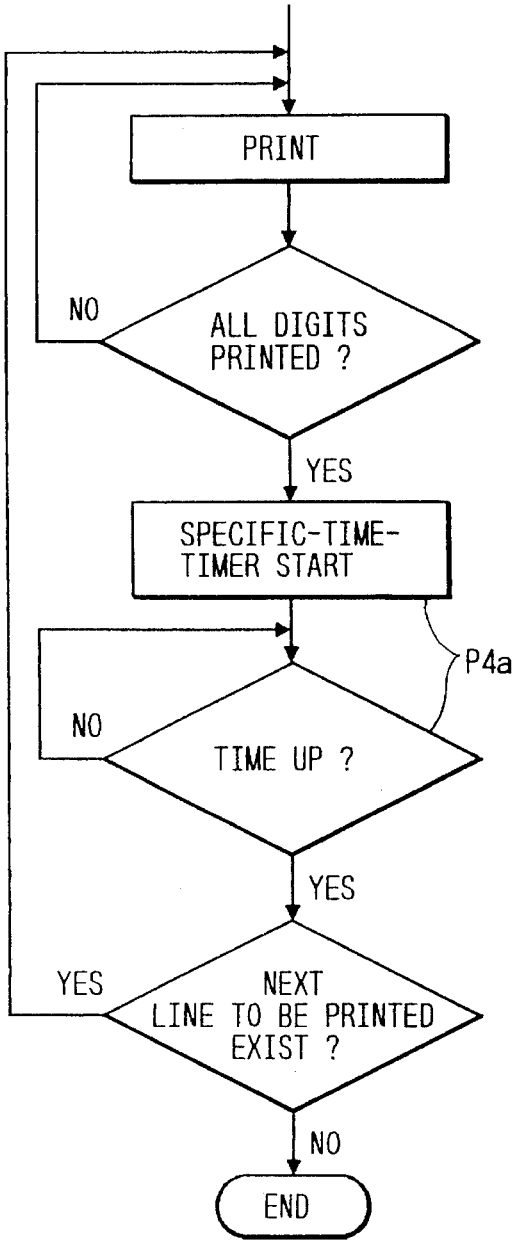
FIG. 4 is a flowchart showing another embodiment of the conventional printer.

FIG. 2 is a portion of a flowchart showing the operation of a controller for a printer, which is second embodiment of the invention. An example in which a timer circuit (including one based on a program) that determines a return time shown in Step P2*a* sets the return time in accordance with the number of printed digits.

Figures 5, 6:
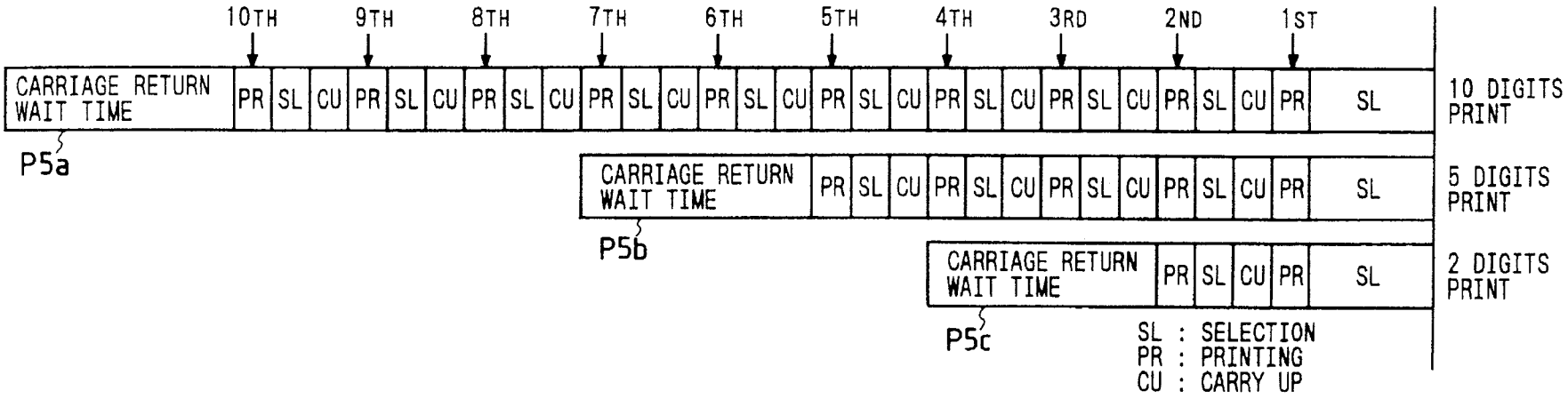
FIG. 5 is a diagram showing breakdowns of printing times according to the conventional printers.
FIG. 6 is a diagram showing ratios of print speeds of the invention to that of the conventional printers.

FIG. 6 is a table showing the ratio of a print speed of a printer driven by an example of the first and second embodiments of the invention to a print speed of a printer driven by the conventional controller. As shown in FIG. 6, the print speed is improved remarkably by the invention as the number of printed digits is small, which is the number of digits often printed by the printer.

Figure 7:
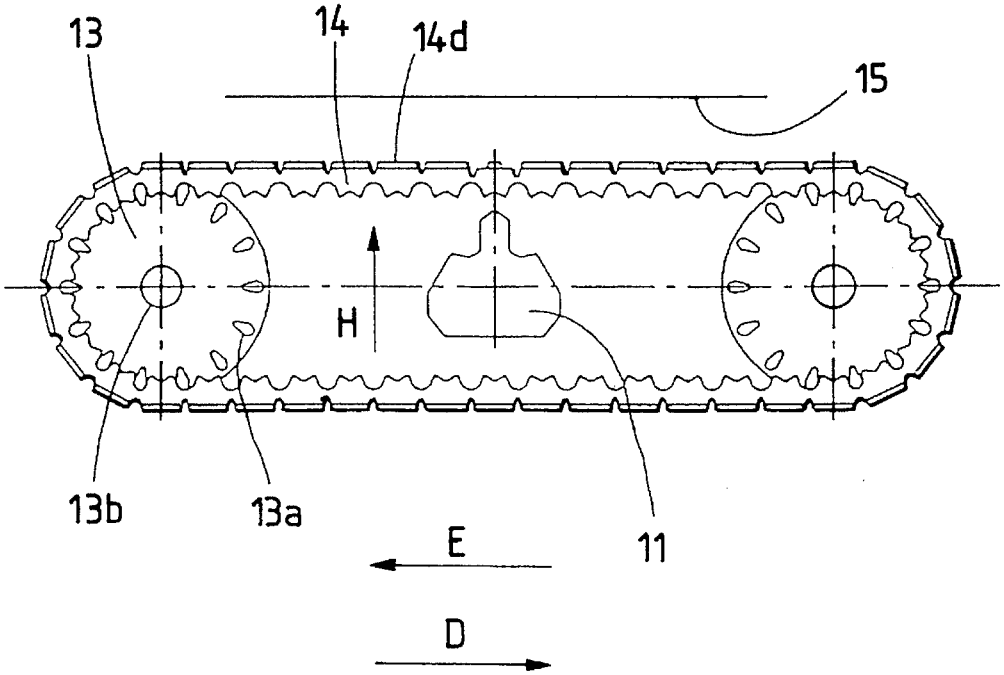
FIG. 7 is a diagram showing an exemplary print mechanism of a serial printer.

FIG. 7 is a top view showing an exemplary print mechanism of the printer controlled by the first embodiment of the invention. A character wheel 14 made of an elastic material with a plurality of characters is connected so as to form a ring. The characters are formed on an outer circumferential surface 14*d*. A hammer 11 is moved by a drive mechanism (not shown) in a direction indicated by an arrow E that is directed toward the upper print digit direction. Then, the hammer 11 causes the character wheel 14 selected by the digit to be biased against a print sheet 15 in a direction indicated by an arrow H. Upon end of printing a single line, the hammer 11 is moved in a direction indicated by an arrow D toward a lower print digit by a return mechanism (not shown) using a spring or the like to return to the print start digit. A cylindrical holding member 13 holds the character wheel 14 and has a central shaft section 13*b* for rotating the character wheel to select a desired character. The holding member is rotated by a holding member rotating mechanism (not shown) so that a character to be printed comes to a position confronting the hammer 11 by a character type detecting mechanism (not shown).

Figure 8:
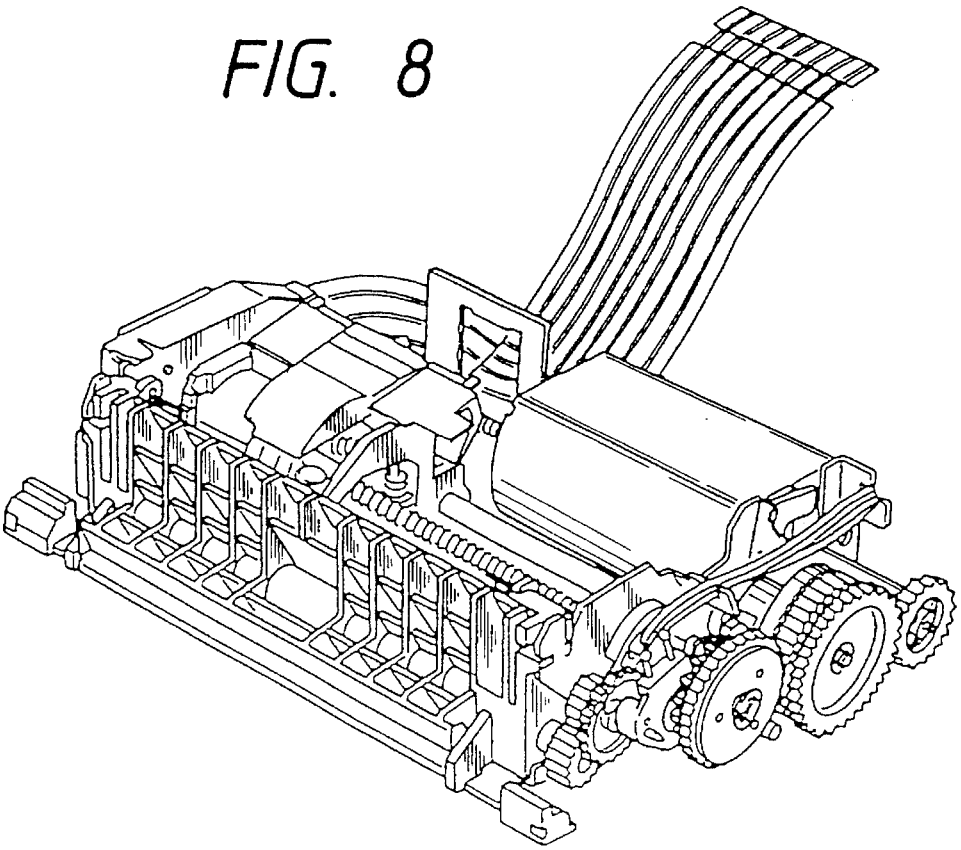
FIG. 8 is a perspective view of the serial printer.
Figure 9:
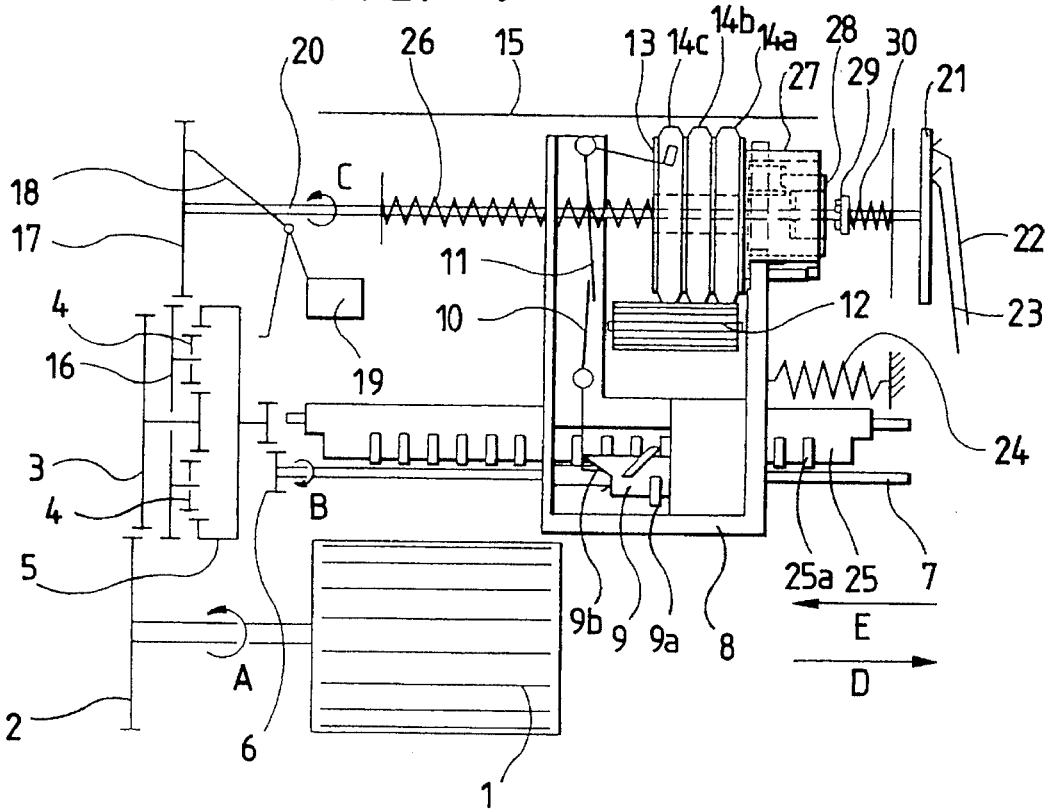
FIG. 9 is a schematic view of the serial printer.
Figure 10:
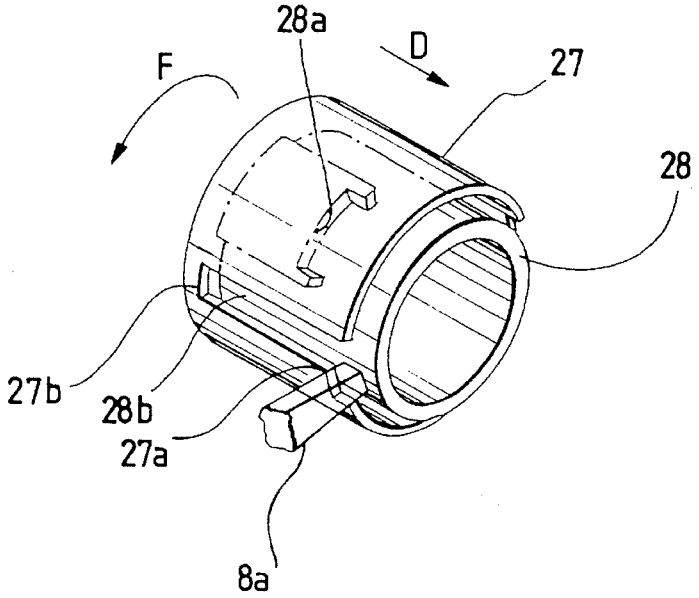
FIG. 10 is a perspective view of a character group switching mechanism.

While what is shown in FIG. 7 is only an exemplary printer using the control method and apparatus of the invention, which is characterized as moving the biasing member in the digit direction, it goes without saying that the control method of the invention may be applied to a printer having a mechanism such that the entire print mechanism including the rotating character wheel is moved in the digit direction and is returned to the print start digit upon end of printing a single line as shown in FIG. 8.

Third Embodiment

Figure 18:
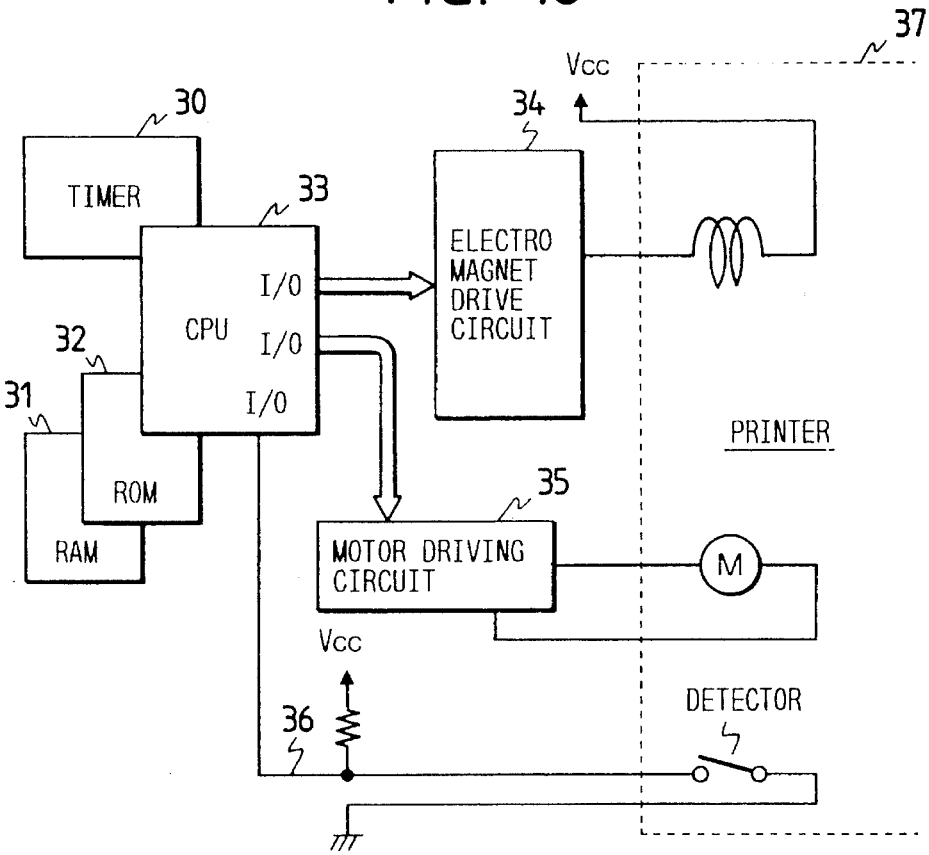
FIG. 18 is a block diagram showing a structure of a controller according to the present invention.
Figure 17:
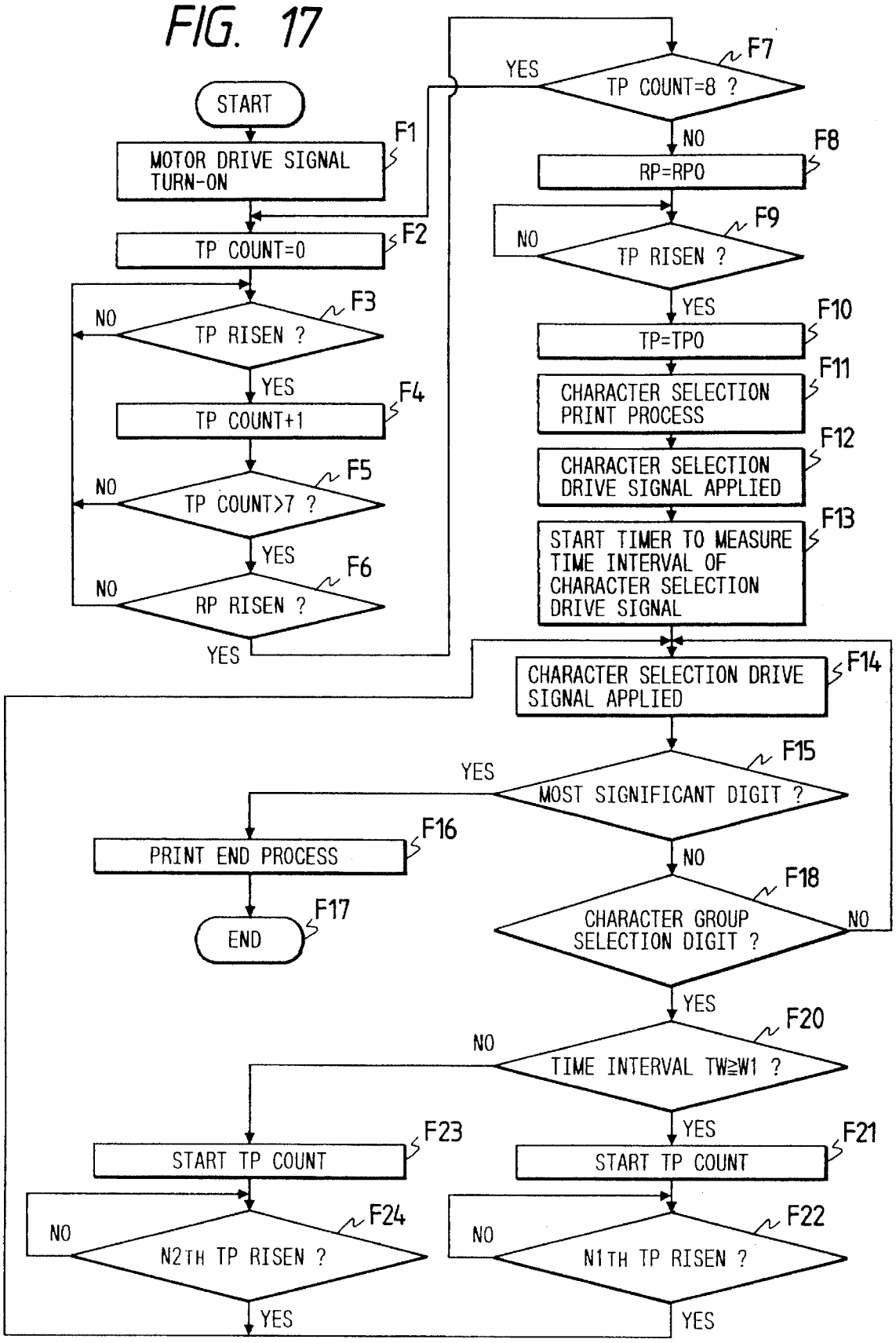
FIG. 17 is a flowchart showing a third embodiment of a printer controller according to the present invention.

FIG. 17 is a flowchart showing the operation of a controller for a printer, which is an embodiment of the fourth aspect of the invention, and FIG. 18 is a block diagram thereof.

Upon activation of a motor, a motor drive signal is applied in Step F1. The number of timing pulses is reset in Step F2. The position of the timing pulse (i.e., whether the timing pulse has risen) is checked repeatedly in Step F3. When the timing pulse has risen, the timing pulse count is incremented by 1 in Step F4. Since the timing pulse interval of a printer using a DC motor becomes substantially constant after several timing pulses have been generated (e.g., within 8 timing pulses in the printer in this embodiment), the controller checks that a predetermined number of timing pulses has risen (the number of timing pulses > 7 in the embodiment) in Steps F3 to F5. This checks a character selection prohibit region g shown in FIG. 22 during which the rotational speed of the motor reaches a steady-state.

When the rising of the predetermined number of timing pulses has been checked, in Step F6 it is determined whether a reset pulse (hereinafter referred to as "RP") has risen. If no RP has risen, the controller returns to Step F3, whereas if an RP has risen, the controller proceeds to Step F7. If an RP has risen after the predetermined number of timing pulses was counted, the controller returns to Step F2 to start counting the number of timing pulses again. If the number of timing pulses is larger than the predetermined number of timing pulses, the controller proceeds to Step F8 to set RP= RP0 to perform the operation of checking that a timing pulse has risen in Step F9. After checking that the timing pulse has been risen, the controller proceeds to Step F10 to set the number of timing pulses to TP0. Then, the controller enters the character selection print process in Step 11.

When a TPn corresponding to a desired character has risen, a character selection drive signal is applied in Step F12, and a timer for measuring a time interval TW of the character selection drive signal is started to measure the time interval TW for TP(n) to TP(n+1) in Step F13. A character selection drive signal for a next digit is applied in Step F14, and in Step F15 it is determined whether the print digit is the most significant digit. If the print digit is the most significant digit, the controller proceeds to Step F16 to execute the print end process and end the control in Step F17. If the print digit is not the most significant digit, the controller proceeds to Step F18 to judge whether the digit is a character group selection digit. If not, the controller returns to Step F14; otherwise, the controller proceeds to Step F20.

In Step F20, the time interval TW is compared with a set value W1. If TW is longer than the set value W1, the controller proceeds to Step F21 to start counting the number of timing pulses. Upon counting the rising of N1 timing pulses in Step F22, the controller returns to Step F14. If TW is shorter than the set value W1, the controller proceeds to Step F23 to start counting the number of timing pulses. In Step F24, the rising of N2 timing pulses is counted, and the controller returns to Step F14. A relationship such as N1< N2 applies to the above control.

Figure 11:
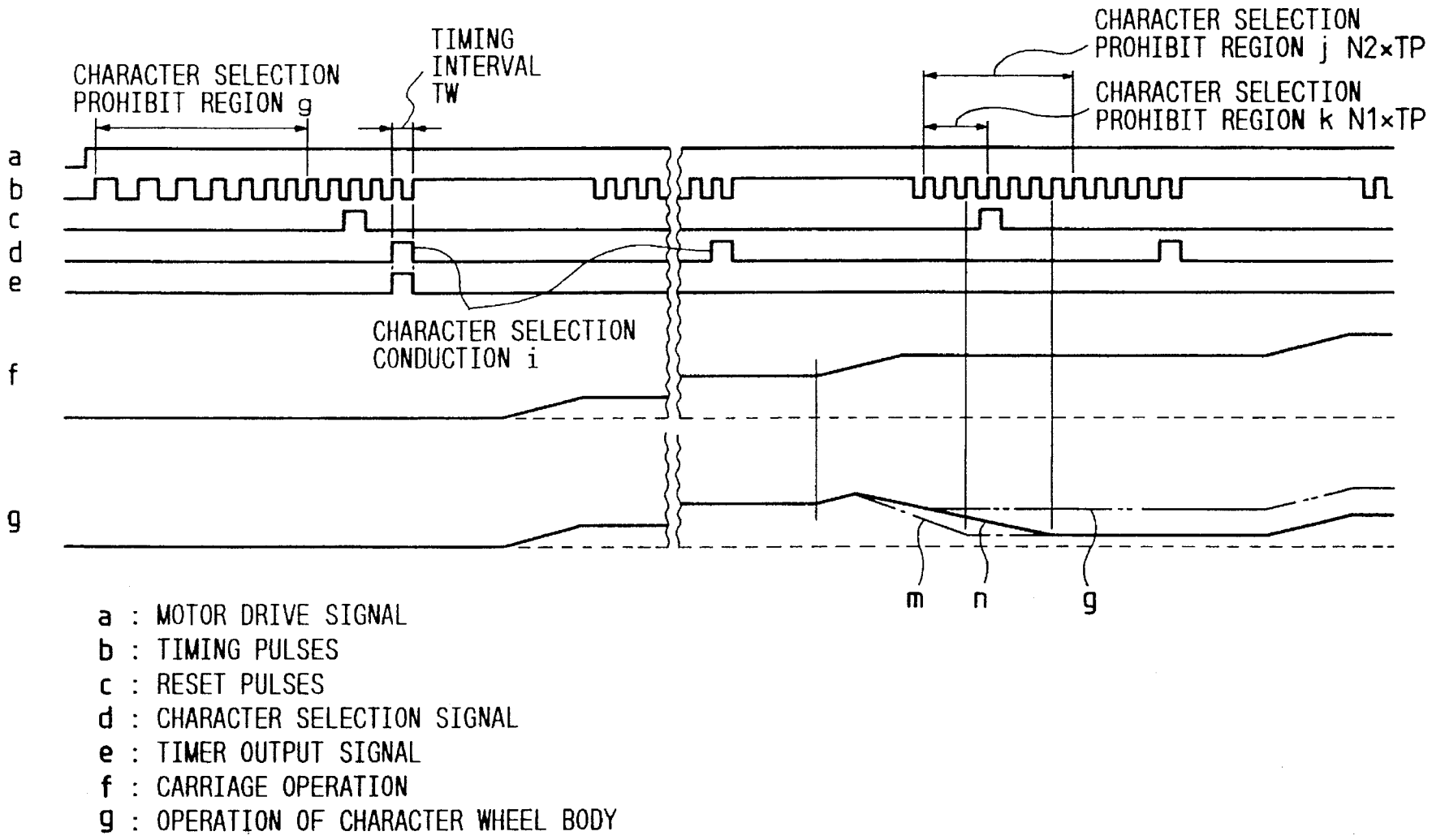
FIG. 11 is a timing chart showing an exemplary control by the conventional printer.
Figure 12:
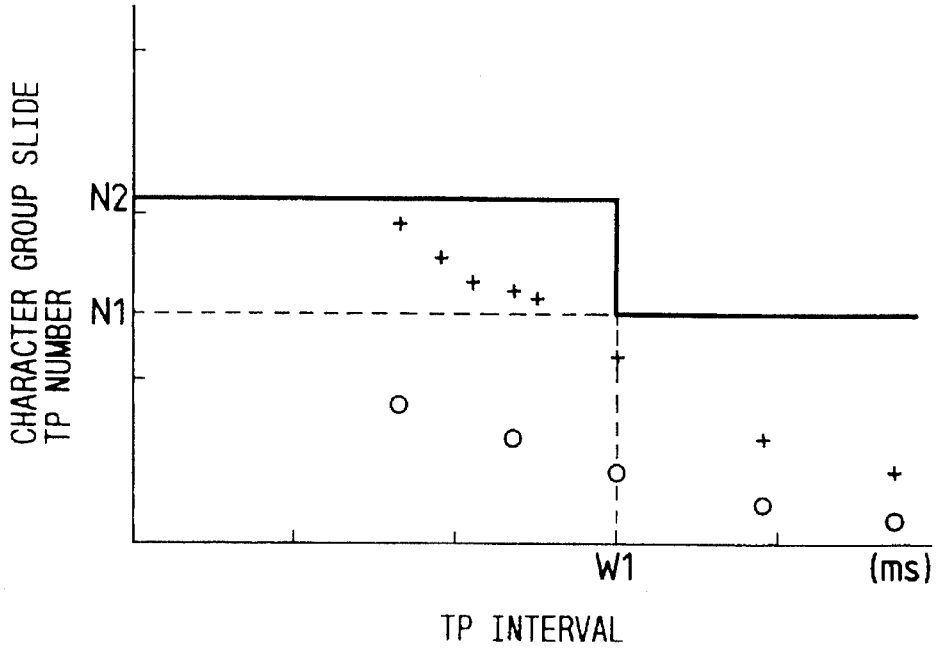
FIG. 12 is a graph showing the number of character group slide timing pulses (TPs) as a function of the TP interval.

While there are two numbers of next digit character selection wait timing pulses after a character group selection (e.g., the character selection wait timing pulses), N2×TP (j) and N1×TP (k), as shown in FIG. 11 in this embodiment, the number may be increased with reference to the graph shown in FIG. 12. If the time interval TW is relatively long during such control, the number of wait timing pulses between a character group selection start to a next digit character selection ready may be decreased.

An exemplary controller of the invention will be described with reference to a block diagram shown in FIG. 18. A control section includes, a timer 30 for measuring the time interval, a RAM 31 for temporarily storing data under arithmetic and logic operations, a ROM 32 for storing programs, a CPU 33 for supervising the entire programs, an electromagnetic drive circuit 34 for sheet feeding, printing, and the like; a motor drive circuit 35 for driving a motor, and a detecting circuit 36 for detecting a timing signal and the like. A printer body side 37 is shown by the broken line.

Fourth Embodiment

Figure 19:
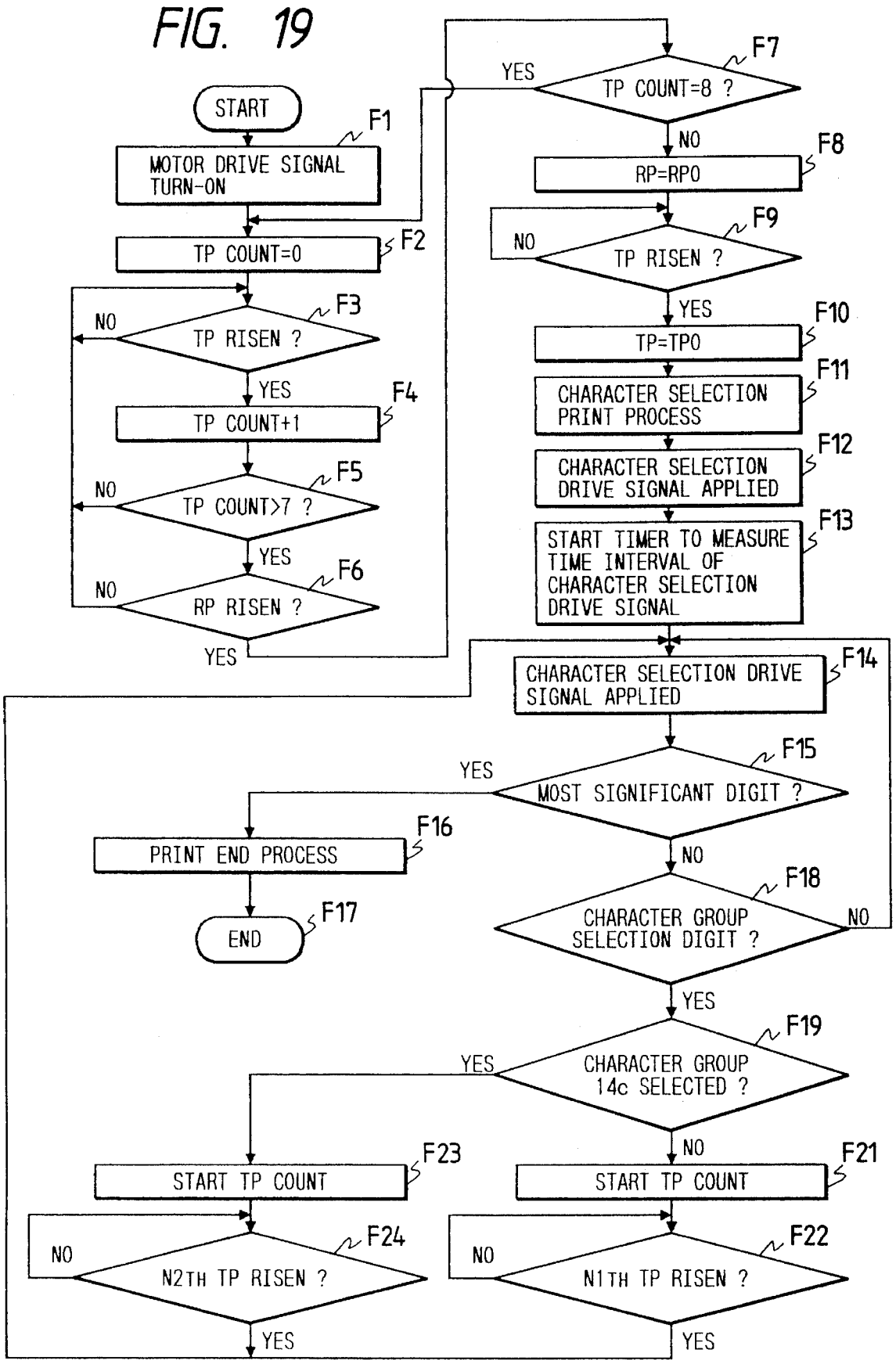
FIG. 19 is a flowchart showing a fourth embodiment of a printer controller according to the present invention.

FIG. 19 is a flowchart showing the operation of a controller for a printer, which is a fourth embodiment of the invention. In FIG. 19, Steps F1 to F11 are the same as those in FIG. 17.

A character selection drive signal is applied in Step F14. In Step F15, a determination is made as to whether the print digit is the most significant digit is checked. If so, the controller proceeds to Step F16. If not, the controller proceeds to Step F18 to judge whether the print digit is a character group selection digit. If not, the controller returns to Step F14. If the print digit is a character group selection digit, the controller proceeds to Step F19.

The character group which has been selected is judged in Step F19. If the character group 14*c* has been selected, the controller proceeds to Step F23. Then, the rising of N2 timing pulses is checked after starting to count the number of timing pulses in Step F24, and the controller returns to Step F14. If the character group 14*b*, as opposed to the character group 14*c*, has been selected in Step F19, the controller proceeds to Step F21. Then, the rising of N1 timing pulses is checked after starting to count the number of timing pulses in Step F24, and the controller returns to Step F14.

Since the character group 14*b* is used often when black ink is applied on the character group 14*b* in red and black two-color printing in this embodiment, the number of wait timing pulses between a character group selection start and a next digit character selection ready can be decreased, thereby improving the practical print speed.

Fifth Embodiment

Figure 20:
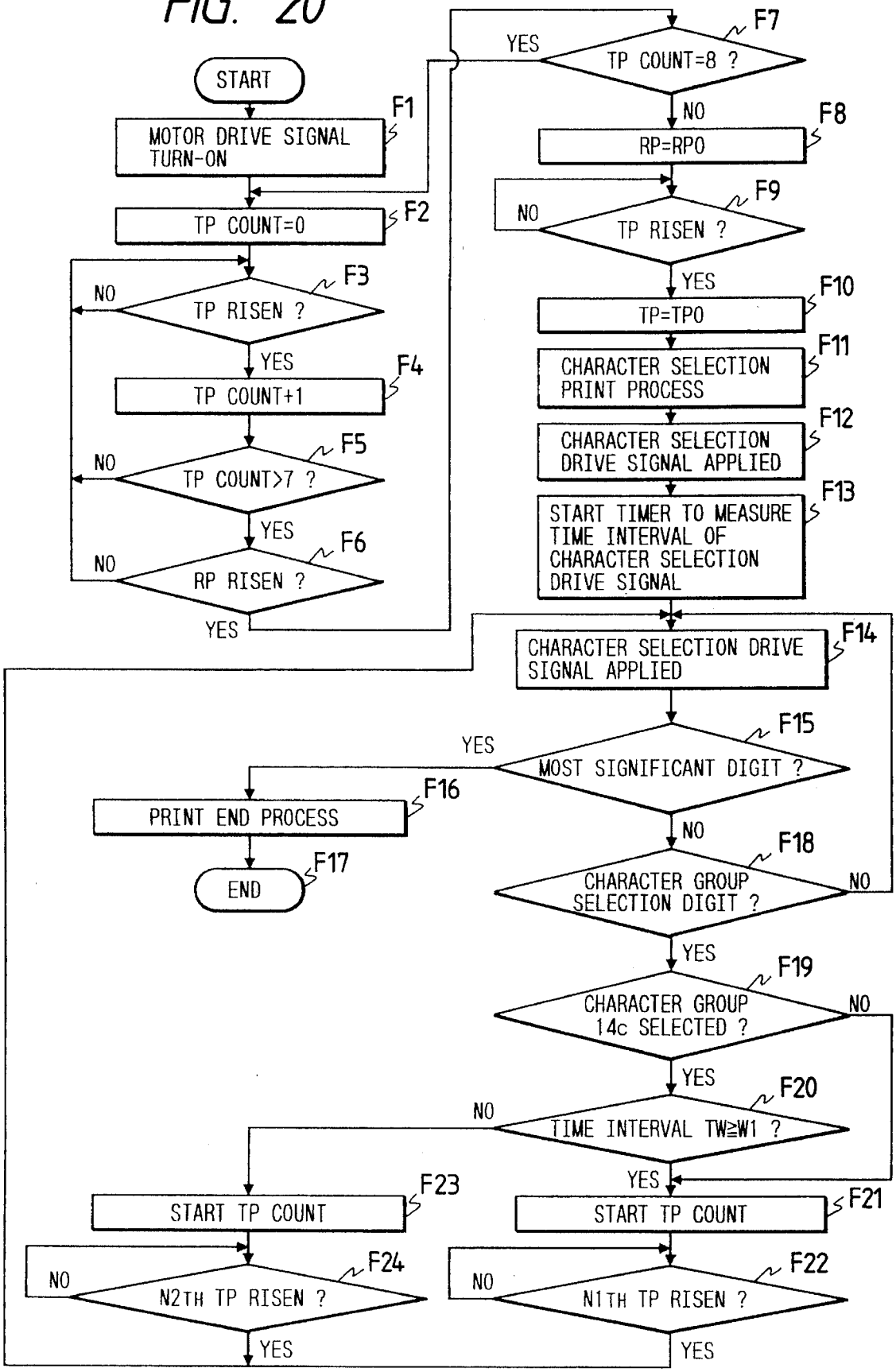
FIG. 20 is a flowchart showing a fifth embodiment of a printer controller according to the present invention.

FIG. 20 is a flowchart showing the operation of a controller for a printer, which is a fifth embodiment of the invention.

In FIG. 20, Steps F1 to F18 are the same as those in FIG. 17. If the print digit is judged to be a character group selection digit in Step F18, the controller proceeds to Step F19. In Step F19, the character group which has been selected is judged. If the character group 14*c* has been selected, the controller proceeds to Step F20. In Step F20, the time interval TW is compared with the set value W1.

If TW is longer than W1, the controller proceeds to Step F21, in which counting of the number of timing pulses is started. After counting the rising of N1 timing pulses in Step F22, the controller returns to Step F14. If TW is shorter than W1, the controller proceeds to F23, in which counting of the number of timing pulses is started. After counting the rising of N2 timing pulses in Step F24, the controller returns to Step F14. If the character group 14*b*, as opposed to the character group 14*c*, has been selected in Step F19, the controller proceeds to Step F21. After executing the above-mentioned control in Steps F21 and F22, the controller returns to Step F14.

The fifth embodiment is characterized as reducing the number of wait timing pulses between a character group selection start and a next digit character selection ready if the time interval TW is long. Even if the time interval TW is short, if the character group 14*b* is the frequently used character group, the number of wait timing pulses between a character group selection start and a next digit character selection ready can be reduced, thus improving the practical print speed.

Sixth Embodiment

Figure 21:
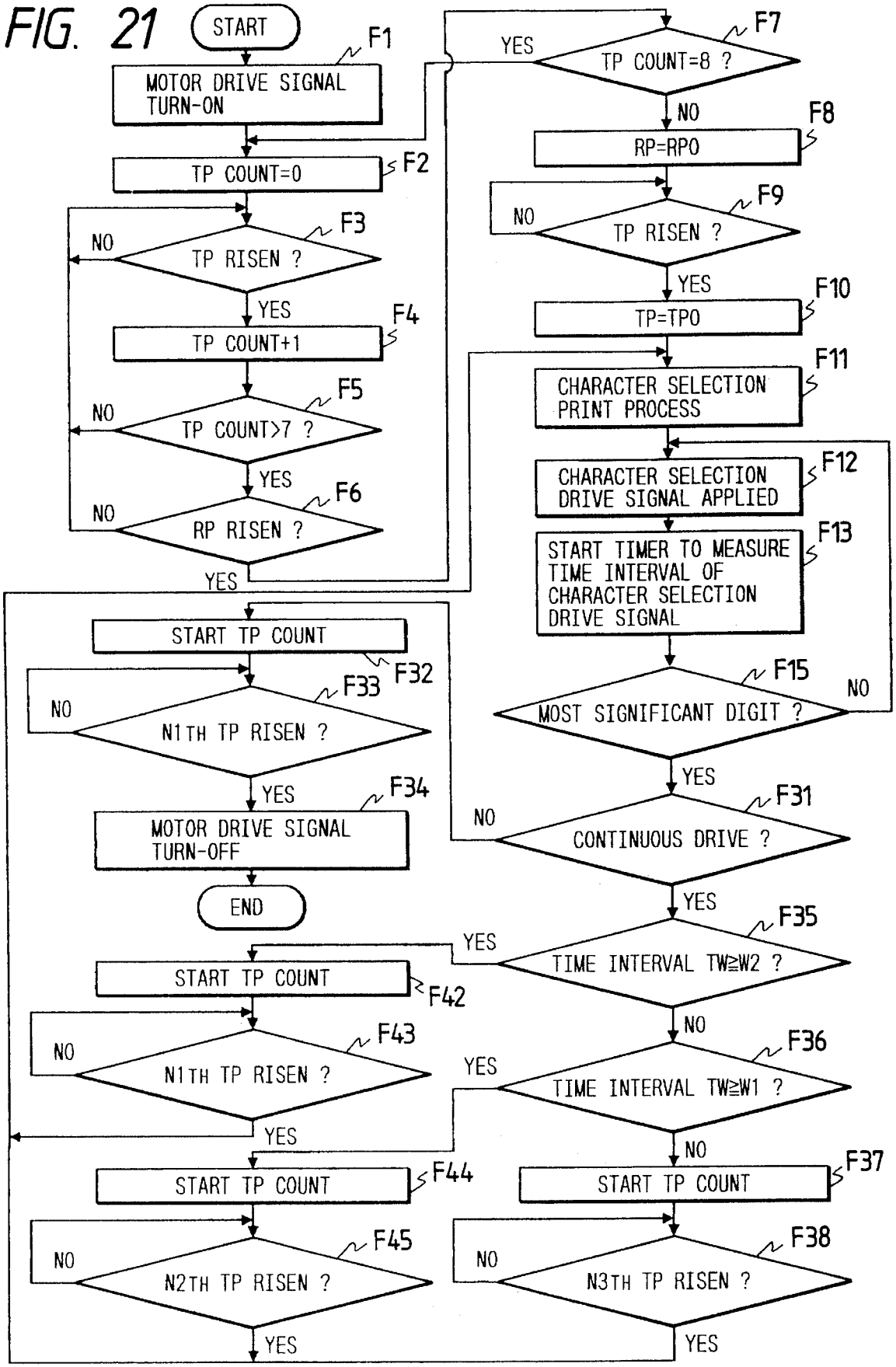
FIG. 21 is a flowchart showing a sixth embodiment of a printer controller according to the present invention.
Figure 22:
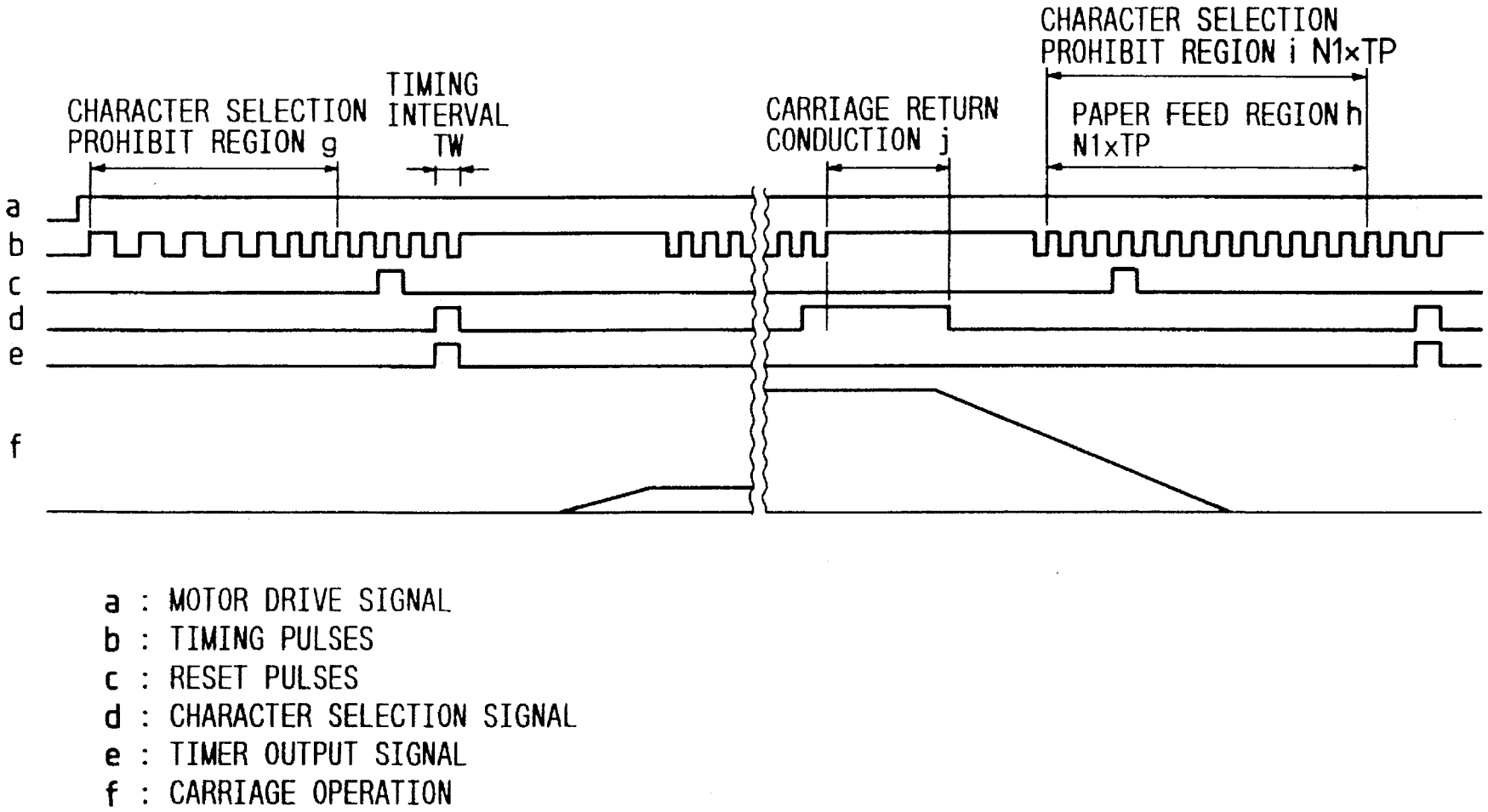
FIG. 22 is a timing chart showing an exemplary control operation by the invention.

FIG. 21 is a flowchart showing the operation of a controller for a printer, which is a sixth embodiment of the invention. FIG. 22 is a timing chart in the case where a motor rotates slowly.

An exemplary controller of the invention will be described according to the flowchart of FIG. 21.

In FIG. 21, Steps F1 to F10 are the same as those in FIG. 17. In Step F11, the controller enters the character selection print process, i.e., a character selection drive signal is applied in Step F12 upon generation of TP(n) corresponding to a desired character. A timer for measuring the time interval TW of the character selection drive signal is started in Step F13 to measure the time interval TW between TP(n) and TP(n+1). In Step F15A it is determined whether the print digit is the most significant digit. If not, the controller returns to Step F12. Otherwise, the controller proceeds to Step F31 to determine whether the continuous drive will be selected. If the continuous drive will not be selected, the controller starts to count the number of timing pulses in Step F32. The control is repeated until N1 timing pulses have risen in Step F33. When the controller proceeds to Step F24, a motor drive signal is turned off. The reason for counting the N1 timing pulses is that sheet feeding of the printer referred to in this embodiment is completed within N1 timing pulses (e.g., the sheet feeding region h in FIG. 22).

If continuous drive is selected, the process continues to Step F35 in which the time interval TW is compared with the set value W2.

Figure 14:
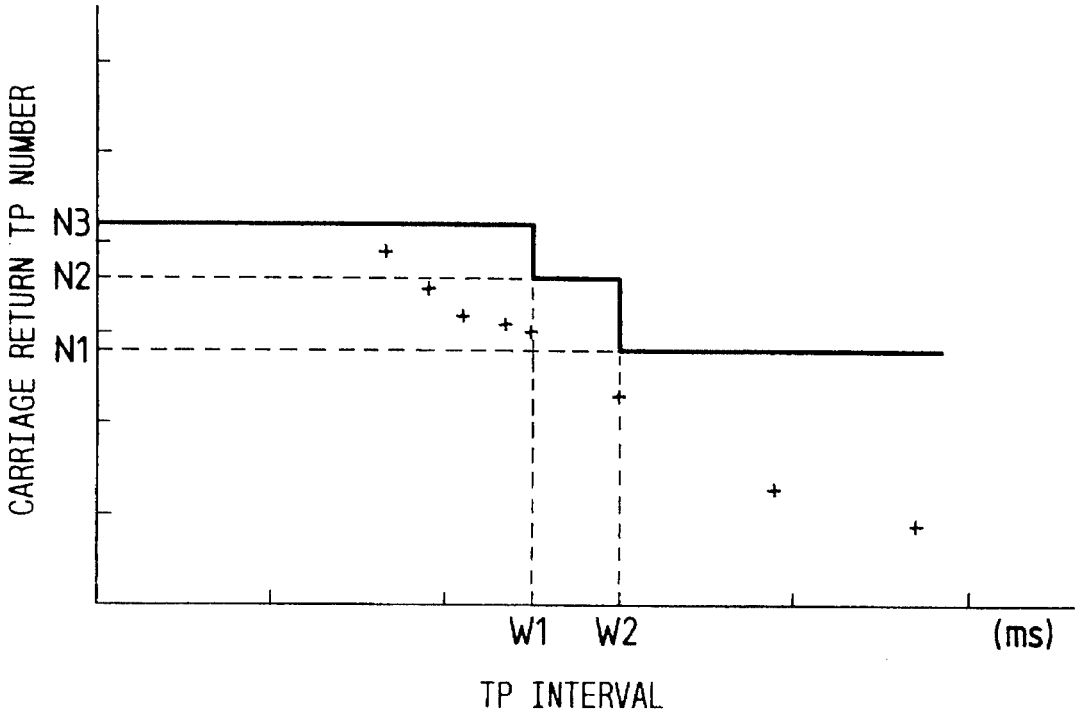
FIG. 14 is a graph showing the TP interval and a number of carriage return TPs.
Figure 13:
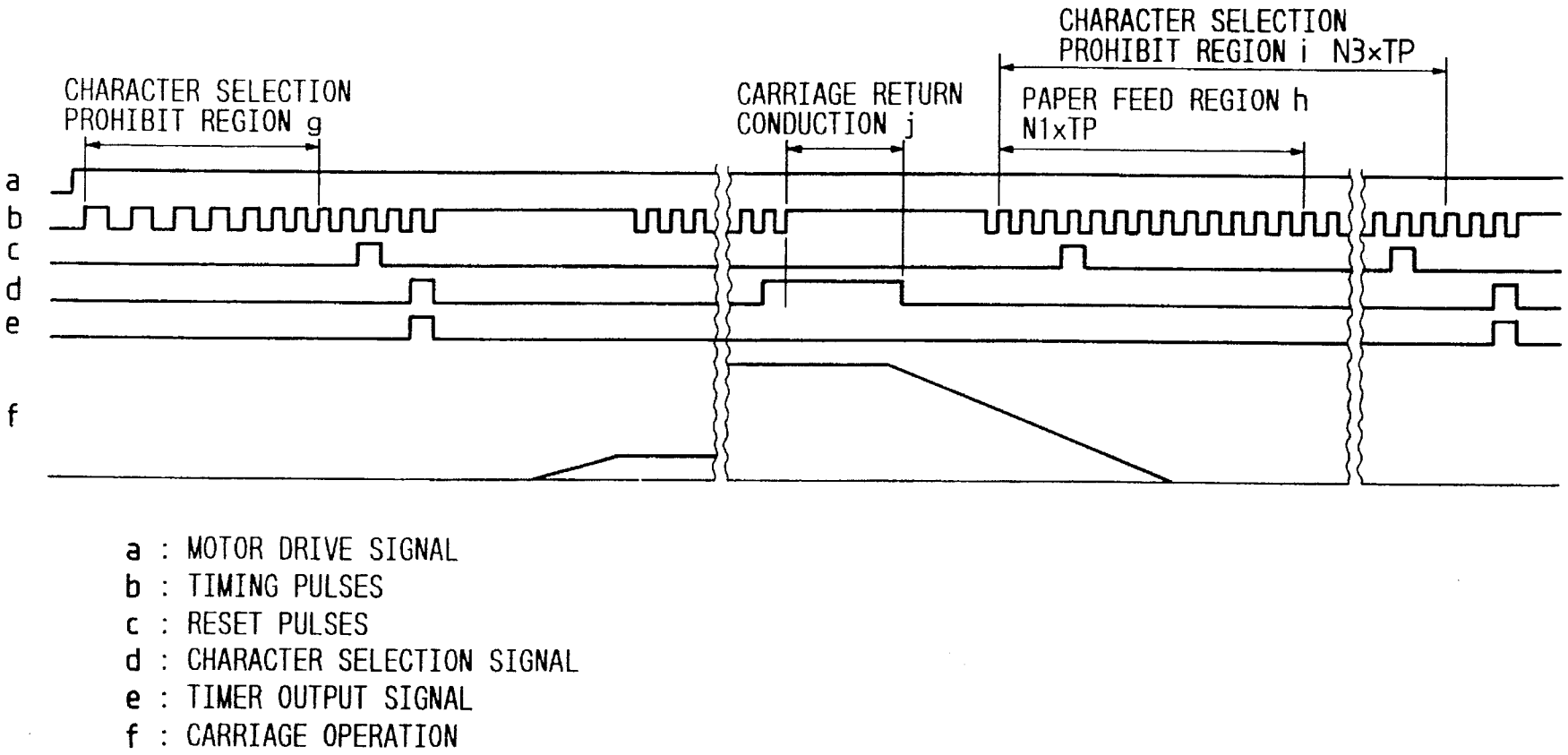
FIG. 13 is a timing chart showing an exemplary control operation by the conventional printer.
Figure 15:
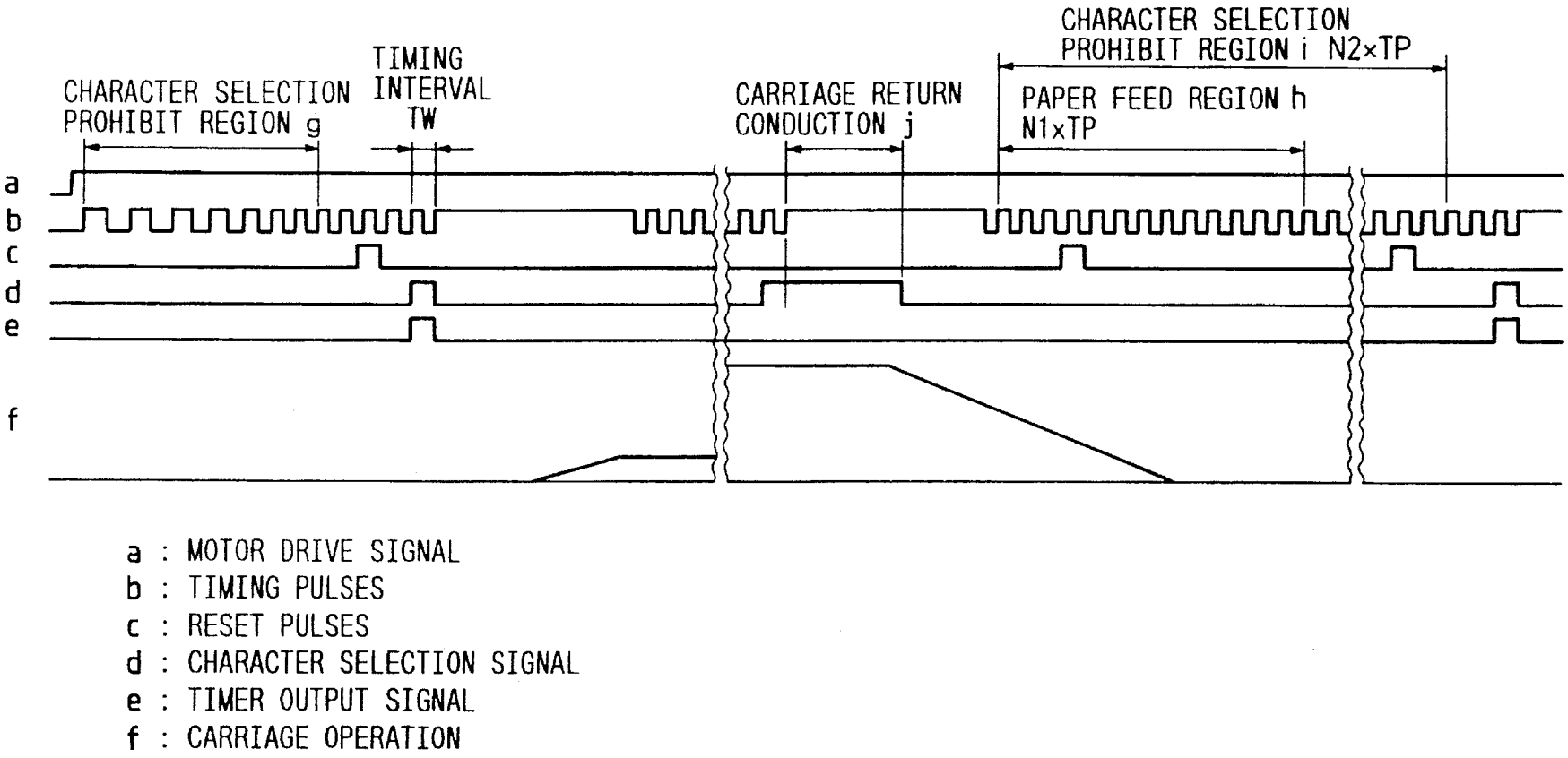
FIG. 15 is a timing chart showing an exemplary control operation by the conventional printer.

As shown in FIG. 14, the set value W2 and the set value W1 in Step F20 are related such that W1< W2. If the power supply voltage is high and the motor speed is high, the time interval TW is smaller than W1. In contrast, if the power supply voltage is high and the motor speed is low, the time interval TW is larger than the set value W2. Values N3, N1, N2 used in Steps F38, F43, and F45 are related such that N1< N2<N3. If the time interval TW is smaller than the set value W2, the controller proceeds to Step F36 to compare the time interval TW with the set value W1.

If TW is smaller than W1, the controller proceeds to Step F37 to start counting the number of timing pulses. The controller repeats counting until N3(th) timing pulse has been generated in Step F38, and then returns to Step F11. In Step 35 if TW is larger than W2, the controller proceeds to Step F42 to start counting the number of timing pulses. The controller repeats counting until N1(th) timing pulse has been generated in Step F43, and then returns to Step F11. If the controller proceeds to Step F42, the time to the next digit print start becomes the shortest because the sheet feed region h is the same as the character selection prohibit region i (e.g., the number of character selection wait timing pulses) shown in FIG. 22.

While the character selection prohibit region i (e.g., the number of character selection wait timing pulses) based on the length of the time interval TW of the character selection drive signal is divided into 3 in this embodiment, the region i may, of course, be divided into 2, 4 or more.

Seventh Embodiment

Figure 23:
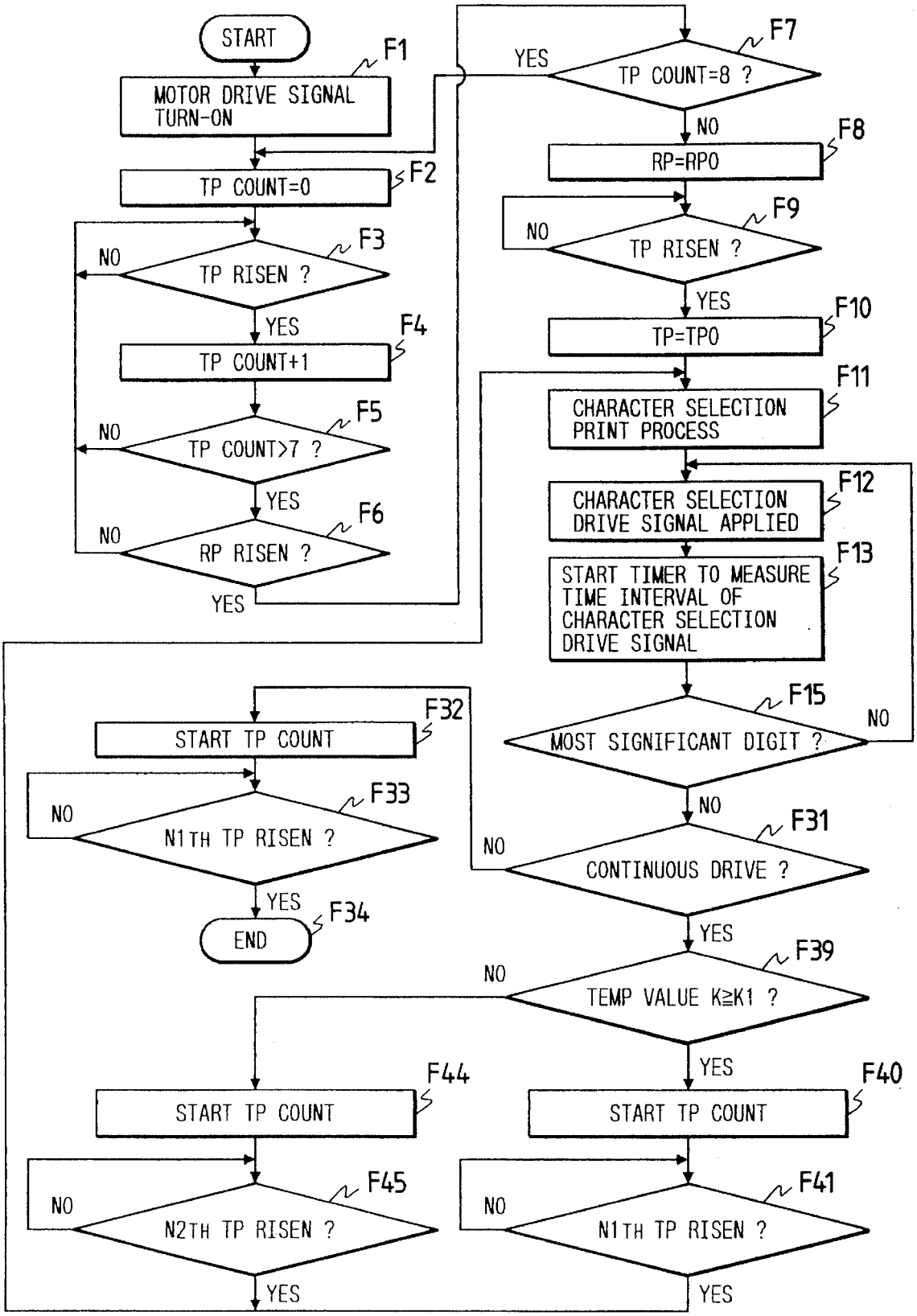
FIG. 23 is a flowchart showing a seventh embodiment of a printer controller according to the present invention.
Figure 24:
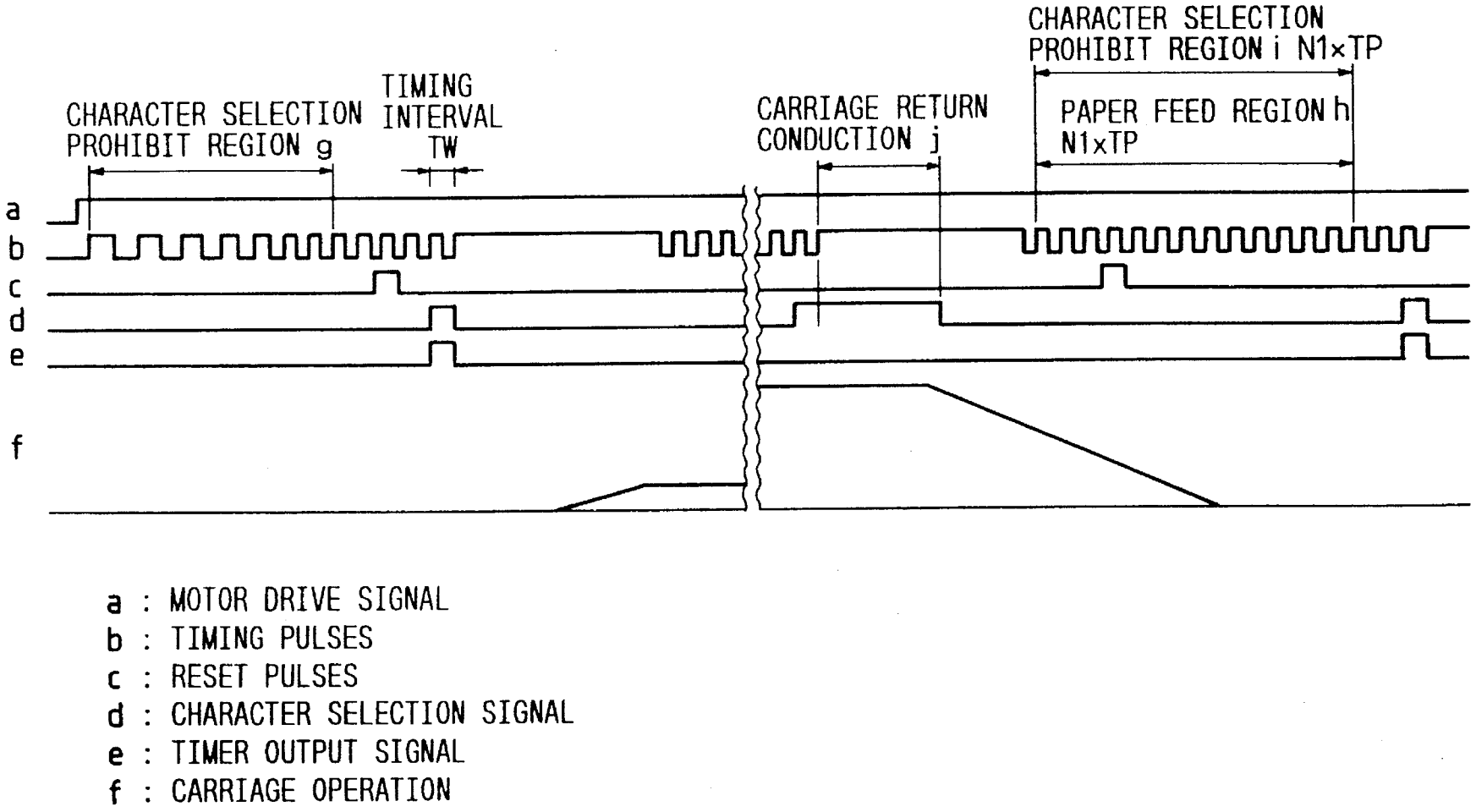
FIG. 24 is a timing chart showing an exemplary control operation by the invention.
Figure 25:
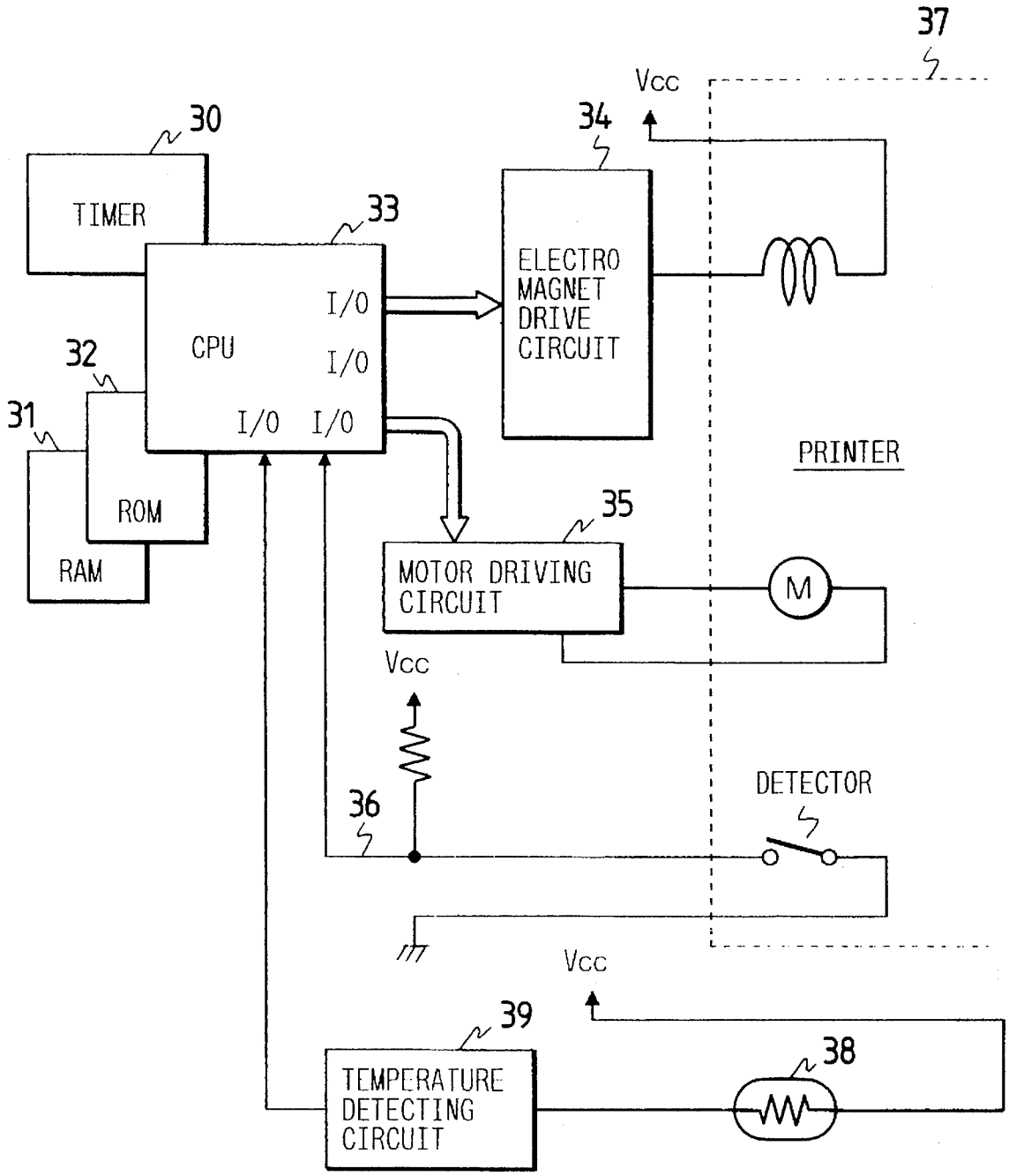
FIG. 25 is a block diagram showing a structure of another controller according to the present invention.

FIG. 23 is a flowchart showing the operation of a printer controller, which is a seventh embodiment of the invention, FIG. 24 is a timing chart at room temperature, and FIG. 25 is a block diagram showing the controller of the invention. In FIG. 23, Steps F1 to F10 are the same as those in FIG. 17.

The controller makes a temperature measurement in Step F11 and then enters the character selection print process.

Upon generation of TP(n) corresponding to a desired character, a character selection drive signal is applied in Step F12. A timer for measuring the time interval TW of the character selection drive signal is started in Step F13 to measure the time interval TW between TP(n) and TP(n+1). In step F15, it is determined whether the print digit is the most significant digit. If not, the controller returns to Step F12; otherwise, the controller proceeds to Step F31 to determine whether the continuous drive will be selected. If the continuous drive will not be selected, the controller starts to count the number of timing pulses in Step F32. The control is repeated until N1 timing pulses have risen in Step F33. When the controller proceeds to Step F24, a motor drive signal is turned off to end the control. The N1 timing pulses are counted so that sheet feeding of the printer referred to in this embodiment is completed within N1 timing pulses (e.g., the sheet feeding region h in FIG. 24).

Figure 16:
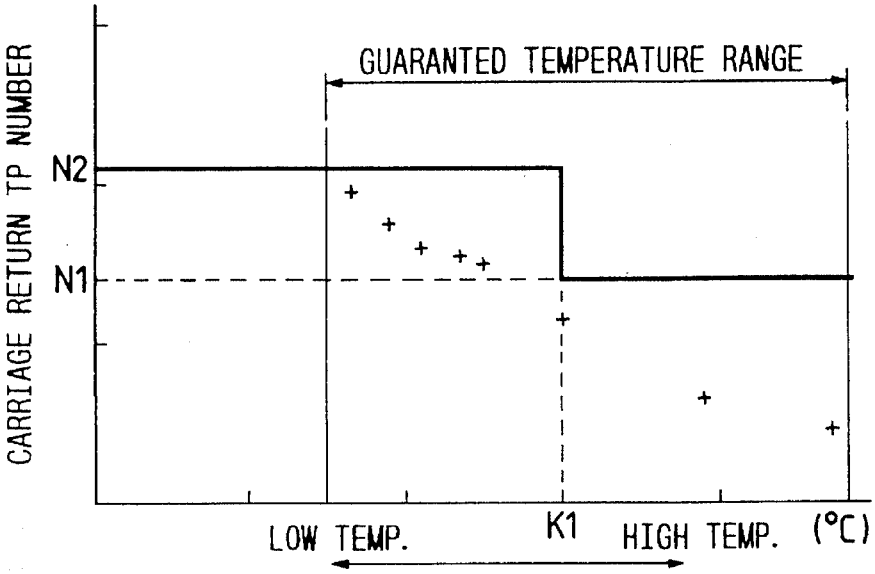
FIG. 16 is a graph showing the number of carriage return TPs as a function of temperature.

If the continuous drive is selected, the controller proceeds to Step F39 to compare the measured temperature K with a set value K1. As shown in FIG. 16, if the measured temperature K is larger than K1 within a temperature compensation range, the character selection prohibit region i (e.g., the number of character selection wait timing pulses) before starting a next line character selection may be N1×TP since the number of timing pulses required for carriage return is smaller than N1. If the measured temperature K is smaller than the set value K1 within the temperature compensation range, the character selection prohibit region i (e.g., the number of character selection wait timing pulses) may be N2×TP because the number of timing pulses for carriage return is smaller than N2.

Hence, if the measured temperature K is larger than the set temperature K1 (e.g., the temperature is high), the controller proceeds to Step F40 to count N1 timing pulses and then returns to Step F11. On the other hand, if the measured temperature K is smaller than the set temperature K1 (the temperature is low), the controller proceeds to Step F44 to count N2 timing pulses and then returns to Step F11.

The set value K1 is a value smaller than room temperature. Thus, the controller proceeds to Step F40 at a usual room temperature, which makes the sheet feed region h becomes equal to the character selection prohibit region i (e.g., the number of character selection wait timing pulses). As a result, the time to a next digit print start is shortened.

While only a single set value is provided in this embodiment, a plurality of set values may, of course, be provided.

An exemplary controller of the invention will be described with reference to a block diagram shown in FIG. 25. A control section includes a timer 30 for measuring the time interval, a RAM 31 for temporarily storing data under arithmetic and logic operations, a ROM 32 for storing programs, a CPU 33 for supervising the entire programs, an electromagnetic drive circuit 34 for sheet feeding, printing, and the like, a motor drive circuit 35 for driving a motor, a detecting circuit 36 for detecting a timing signal and the like, and a temperature detecting circuit 39 connected to a thermistor 38. A portion of a printer body 37 is shown by broken lines. The thermistor 38 may be mounted on the printer body 37.

As described above, according to the invention, a first digit character to be printed in succession to a last line after a carriage moving in a digit direction has completed a printing of a single line and has returned to a print start digit is selected by counting a predetermined number of timing pulses to be generated during the carriage return, and the predetermined number is set so as to correspond to the character to be printed and the number of digits printed in the last line. Therefore, since the predetermined number of timing pulses can be small when the number of digits to be printed is small and therefore the time required for the carriage return is short, the print speed can be improved.

Further, the invention includes a time measuring device for estimating a completion of the carriage return to the home position, the completion time differing depending on the number of printed digits, and a first digit to be printed in succession to a last line is selected by measuring a predetermined carriage return time, and the predetermined carriage return time is set so as to correspond to the character to be printed and the number of digits printed in the last line. Therefore, since the predetermined number can be small when the number of digits to be printed is small and therefore the time required for the carriage return is short, the print speed can be improved.

Still further, even if the printer is used over a wide voltage range, the invention includes a device for detecting a timing pulse interval, and a first digit character after a selection of a character group is selected by counting a predetermined number of timing pulses to be generated during the character group selection, and the predetermined number of timing pulses is set so as to correspond to the value detected by the timing pulse interval detecting device. Therefore, the selection of the character can be made to correspond to the motor speed, and the print speed of the printer can be improved since the predetermined number of timing pulses can be small when the printer is operating under a low power supply voltage region.

Still further, even if the printer is used over a wide voltage range, a first digit character after a selection of a character group is selected by a number of timing pulses to be generated during the selection of the character group, and the predetermined number is set so as to correspond to the selected character group. Therefore, the print speed can be improved by reducing the predetermined number of timing pulses during printing in which the frequently used character group is selected irrespective of the power supply voltage.

Still further, the invention includes a device for measuring the ambient temperature of the serial printer, and a first digit character after a selection of a character group is selected by counting a predetermined number of timing pulses to be generated during the selection of the character group, and the number of timing pulses is set so as to correspond to the temperature measured by the temperature measuring device. Therefore, the print speed can be improved by reducing the predetermined number of timing pulses at temperatures at which the printer is often used.

Still further, the invention includes a device for detecting a timing pulse interval, and a first digit character to be printed in succession to a last line is selected by counting a predetermined number of timing pulses to be generated during the carriage return, and the number of timing pulses is set so as to correspond to the value detected by the timing pulse interval detecting device. Therefore, the selection of the character can be made to correspond to the motor speed, and the print speed of the printer can be improved since the predetermined number of timing pulses can be small when the printer is operating under the low power supply voltage region.

Still further, the invention includes a device for detecting the ambient temperature of the serial printer, and a first digit character to be printed in succession to a last line is selected by counting a predetermined number of timing pulses to be generated during the carriage return, and the number of timing pulses is set so as to correspond to the character to be printed and the temperature measured by the temperature measuring device. Therefore, the print speed can be improved by reducing the predetermined number of timing pulses at temperatures at which the printer is often used. That is, since the predetermined number of timing pulses can be changed in accordance with the temperature conditions, it is not necessary to increase the strength of the carriage spring to improve the speed of returning the carriage at low temperatures. The print speed in a continuous printing operation at temperatures at which the printer is normally used can be improved without increasing power consumption due to an increase in load or noise during carriage return.

Thus, tremendous advantages are provided by a serial printer according to the invention whose speed is high under often used characters, temperatures, and power supply voltages, without increasing the shape, weight, power consumption, price, or noise of the printer, or using highly durable parts.

Although the present invention has been fully described by way of the embodiments thereof with reference to the accompanying drawings, various changes and modifications will be apparent to those having skill in this field without departing from the scope of the invention as defined in the appended claims.

What is claimed is:

1. A method for controlling a serial printer using a DC motor as a power source, said serial printer including means for generating timing pulses in correspondence to a rotation of a character device, means for causing a carriage holding print means to consecutively move in a digit direction, means for selecting a desired character of said character device to be printed by counting a predetermined number of the timing pulses, means for stopping the rotation of the character device for a predetermined time determined by a gear train while energizing an electromagnet, means for conducting a printing operation by biasing the desired character with the print means and rotating the character device after the carriage has been moved to a next digit, and means for starting a rotation of the character device and a generation of the timing pulses before the carriage is returned to a home position by biasing means while utilizing movement of the carriage, said method comprising the steps of:

setting the number of timing pulses based on a first digit character to be printed by the serial printer and a last digit character printed in a last line; and counting the predetermined number of timing pulses to select the character to be printed as the first digit character.

2. A method for controlling a serial printer using a DC motor as a power source, said serial printer including means for generating timing pulses in correspondence to a rotation of a character device, means for causing a carriage holding print means to consecutively move in a digit direction, means for selecting a desired character of said character device to be printed by counting a predetermined number of timing pulses, means for stopping the rotation of the character device for a predetermined time determined by a gear train while energizing an electromagnet, means for conducting a printing operation by biasing the desired character with the print means and rotating the character device after the carriage has been moved to a next digit, and means for starting a rotation of the character device and a generation of the timing pulses before the carriage is returned to a home position by biasing means while utilizing movement of the carriage, said method comprising the steps of:

estimating completion of the carriage return to a home position by counting a predetermined number of timing pulses, the timing pulses being generated in association with the rotation of the character device time and corresponding to the number of digits printed.

3. A method for controlling a serial printer using a DC motor as a power source, said serial printer including means for generating timing pulses in correspondence to a rotation of a character device, means for causing a carriage holding print means to consecutively move in a digit direction, means for selecting a desired character of said character device to be printed by counting a predetermined number of timing pulses, means for stopping the rotation of the character device for a predetermined time determined by a gear train while energizing an electromagnet, means for conducting a printing operation by biasing the character with the print means and rotating the character device after the carriage has been moved to a next digit, and means for returning the carriage to a home position while utilizing movement of the carriage after a printing of a predetermined number of digits has been completed, said method comprising the following steps:

estimating a completion time of the carriage return to the home position, the completion time differing depending on a number of printed digits; and selecting a first digit character to be printed in succession to a last line by measuring a predetermined carriage return time, the predetermined carriage return time being set so as to correspond to the character to be printed and the number of digits printed in the last line.

4. An apparatus for controlling a serial printer adapted for use with a DC motor, said serial printer including means for generating timing pulses in correspondence to a rotation of a character device having a plurality of selectable character groups, means for causing a carriage holding print means to consecutively move in a digit direction to print every digit, means for selecting a character group while printing a single line, means for starting the generation of the timing pulses upon start of the rotation of the character before completing the selection of the character group, and means for returning the carriage to a home position while utilizing movement of the carriage after a printing of a predetermined number of digits has been completed, said apparatus comprising:

means for detecting a timing pulse interval;

means for selecting a first digit character after a selection of a character group by counting a predetermined number of timing pulses to be generated during the character group selection; and means for setting the predetermined number of timing pulses so as to correspond to a value detected by the timing pulse interval detecting means.

5. An apparatus for controlling a serial printer adapted for use with a DC motor, said serial printer including means for generating timing pulses in correspondence to a rotation of a character device having a plurality of selectable character groups, means for causing a carriage holding print means to consecutively move in a digit direction to print every digit, means for selecting a character group while printing a single line, means for starting to generate the timing pulses upon start of the rotation of the character device before completion of the selection of the character group, and means for causing the carriage to return to a home position while utilizing movement of the carriage after printing of a predetermined number of digits has been completed, said apparatus comprising:

means for selecting a first digit character after a selection of a character group according to a number of timing pulses generated during the selection of the character group; and means for setting the predetermined number so as to correspond to the selected character group.

6. An apparatus for controlling a serial printer adapted for use with a DC motor as claimed in claim 5, said serial printer including means for generating timing pulses in correspondence to a rotation of a character device having a plurality of selectable character groups, means for causing a carriage holding print means to consecutively move a digit direction to print every digit, means for selecting a character group while printing a single line, means for starting to generate the timing pulses upon start of the rotation of the character device before completing the selection of the character group, and means for causing the carriage to return to a home position while utilizing movement of the carriage after printing of a predetermined number of digits has been completed, said apparatus comprising:

means for measuring an ambient temperature of the serial printer;

means for selecting a first digit character after a selection of a character group by counting a predetermined number of timing pulses to be generated during the selection of the character group; and means for setting the number of timing pulses in response to the ambient temperature measured by the temperature measuring means.

7. A method for controlling a serial printer according to claim 1, further comprising the steps of:

detecting a timing pulse interval; and selecting a first digit character to be printed in succession to a last line by counting a predetermined number of timing pulses to be generated during the carriage return, the number of timing pulses being set so as to correspond to the timing pulse interval detected.

8. A method for controlling a serial printer according to claim 1, further comprising the step of measuring an ambient temperature of said serial printer, wherein the setting step includes setting the number of timing pulses in response to the character to be printed and the ambient temperature measured.

9. An apparatus for controlling a serial printer adapted for use with a DC motor, said printer including means for generating timing pulses in correspondence to a rotation of a character device having a plurality of selectable character groups, means for causing a carriage holding print means to consecutively move in a digit direction to print every digit, means for selecting a character group while printing a single line, means for starting the generation of the timing pulses upon start of the rotation of the character device before completing the selection of the character group, and means for returning carriage to a home position while utilizing movement of the carriage after a printing of a predetermined number of digits has been completed, said apparatus comprising:

means for detecting a timing pulse interval;

means for selecting a first digit character after a selection of a character group by counting a predetermined number of timing pulses to be generated during the character group selection; and means for setting the predetermined number of timing pulses so as to correspond to a value detected by the timing pulse interval detecting means and to correspond to the selected character group.

10. A method for controlling a serial printer adapted for use with a DC motor, including means for generating timing pulses in correspondence to a rotation of a character device having a plurality of selectable character groups, means for causing a carriage holding print means to consecutively move in a digit direction to print every digit, means for selecting a character group while printing a single line, means for starting to generate the timing pulses upon start of the rotation of the character device before completion of the selection of the character group, and means for causing the carriage to return to a home position while utilizing movement of the carriage after printing of a predetermined number of digits has been completed, and means for controlling the printer, said controlling means comprising means for selecting a first digit character after a selection of a character group according to a number of timing pulses generated during the selection of the character group, and means for setting the predetermined number so as to correspond to the selected character group, said method comprising the steps of:

selecting a first digit character to be printed in succession to a last line by counting a predetermined number of timing pulses to be generated during the carriage return; and setting the predetermined number of timing pulses so as to correspond to the character to be printed and the number of digits printed in the last line.

11. An apparatus for controlling a serial printer adapted for use with a DC motor, said serial printer including means for generating timing pulses in correspondence to a rotation of a character device having a plurality of selectable character groups, means for causing a carriage holding print means to consecutively move in a digit direction to print every digit, means for selecting a character group while printing a single line, means for starting the generation of the timing pulses upon start of the rotation of the character device before completing the selection of the character group, and means for returning the carriage to a home position while utilizing movement of the carriage after a printing of a predetermined number of digits has been completed, said apparatus comprising:

means for detecting a timing pulse interval;

means for selecting a first digit character after a selection of a character group by counting a predetermined number of timing pulses to be generated during the character group selection; and means for setting the predetermined number of timing pulses so as to correspond to a value detected by the timing pulse interval detecting means and to correspond to the selected character group, wherein a first digit character to be printed in succession to a last line is selected by counting a predetermined number of timing pulses to be generated during the carriage return, the number of timing pulses being set so as to correspond to the timing pulse interval detected.

12. An apparatus for controlling a serial printer adapted for use with a DC motor, said serial printer including means for generating timing pulses in correspondence to a rotation of a character device having a plurality of selectable character groups, means for causing a carriage holding print means to consecutively move in a digit direction to print every digit, means for selecting a character group while printing a single line, means for starting the generation of the timing pulses upon start of the rotation of the character device before completing the selection of the character group, and means for returning the carriage after a printing of a predetermined number of digits has been completed, said apparatus comprising:

means for detecting a timing pulse interval;

means for setting a predetermined number of timing pulses so as to correspond to a value detected by the timing pulse interval detecting means and the number of digits printed in the last line, the number of timing pulses being set so as to correspond to the timing pulse interval detected; and, means for selecting a first digit character after a selection of a character group by counting the predetermined number of timing pulses to be generated during the character group selection.

13. An apparatus for controlling a serial printer adapted for use with a DC motor, said serial printer including means for generating timing pulses in correspondence to a rotation of a character device having a plurality of selectable character groups, means for causing a carriage holding print means to consecutively move in a digit direction to print every digit, means for selecting a character group while printing a single line, means for starting to generate the timing pulses upon start of the rotation of the character device before completing the selection of the character group, and means for causing the carriage to return to a home position while utilizing movement of the carriage after printing of a predetermined number of digits has been completed, said apparatus comprising:

means for measuring an ambient temperature of the serial printer;

means for selecting a first digit character after a selection of a character group by counting a predetermined number of timing pulses to be generated during the selection of the character group; and means for setting the number of timing pulses so as to correspond to the ambient temperature measured by the temperature measuring means, wherein a first digit character to be printed in succession to a last line is selected by counting a predetermined number of timing pulses to be generated during the carriage return, and the number of timing pulses in response to correspond to the character to be printed and the ambient temperature measured by the temperature measuring means.

14. A serial printer, comprising:

means for generating timing pulses in correspondence to a rotation of a character device having a plurality of selectable character groups;

means for causing a carriage holding print means to consecutively move in a digit direction to print every digit;

means for selecting a character group while printing a single line;

means for starting the generation of the timing pulses upon start of the rotation of the character device before completing the selection of the character group;

means for returning the carriage to a home position while utilizing movement of the carriage after a printing of a predetermined number of digits has been completed; and means for controlling the serial printer, said controlling means comprising means for detecting a timing pulse interval, means for selecting a first digit character after a selection of a character group by counting a predetermined number of timing pulses to be generated during the character group selection, and means for setting the predetermined number of timing pulses so as to correspond to a value detected by the timing pulse interval detecting means.

15. A serial printer, comprising:

means for generating timing pulses in correspondence to a rotation of a character device having a plurality of selectable character groups;

means for causing a carriage holding print means to consecutively move in a digit direction to print every digit;

means for selecting a character group while printing a single line;

means for starting to generate the timing pulses upon start of the rotation of the character device before completion of the selection of the character group;

means for causing the carriage to return to a home position while utilizing movement of the carriage after printing of a predetermined number of digits has been completed;

means for selecting a first digit character after a selection of a character group by a number of timing pulses generated during the selection of the character group; and means for setting the predetermined number so as to correspond to the selected character group.

16. A serial printer as recited in claim 5, comprising:

means for generating timing pulses in correspondence to a rotation of a character device having a plurality of selectable character groups;

means for causing a carriage holding print means to consecutively move in a digit direction to print every digit;

means for selecting a character group while printing a single line;

means for starting to generate the timing pulses upon start of the rotation of the character device before completing the selection of the character group;

means for causing the carriage to return to a home position while utilizing movement of the carriage after printing of a predetermined number of digits has been completed;

means for controlling the serial printer, said controlling means comprising means for measuring an ambient temperature of the serial printer;

means for selecting a first digit character after a selection of a character group by counting a predetermined number of timing pulses to be generated during the selection of the character group; and means for setting the number of timing pulses so as to correspond to the ambient temperature measured by the temperature measuring means.

17. A serial printer according to claim 14, further comprising a power source, said power source comprising a DC motor.

18. A serial printer according to claim 15, further comprising a power source, said power source comprising a DC motor.

19. A serial printer according to claim 16, further comprising a power source, said power source comprising a DC motor.

20. A serial printer according to claim 14, further comprising means for detecting a timing pulse interval, wherein said first digit character to be printed in succession to a last line is selected by counting a predetermined number of timing pulses to be generated during the carriage return, the number of timing pulses being set so as to correspond to the timing pulse interval detected.

21. A serial printer according to claim 15, further comprising means for detecting a timing pulse interval, wherein said first digit character to be printed in succession to a last line is selected by counting a predetermined number of timing pulses to be generated during the carriage return, the number of timing pulses being set so as to correspond to the timing pulse interval detected.

22. A serial printer according to claim 16, further comprising means for detecting a timing pulse interval, wherein said first digit character to be printed in succession to a last line is selected by counting a predetermined number of timing pulses to be generated during the carriage return, the number of timing pulses being set so as to correspond to the timing pulse interval detected.

* * * * *